US007525559B2

(12) United States Patent
Furukawa et al.

(10) Patent No.: US 7,525,559 B2
(45) Date of Patent: Apr. 28, 2009

(54) EVALUATION APPARATUS OF LIQUID CRYSTAL DISPLAY DEVICE, LIQUID CRYSTAL DISPLAY DEVICE, AND EVALUATION METHOD OF LIQUID CRYSTAL DISPLAY DEVICE

(75) Inventors: Tomoo Furukawa, Matsusaka (JP); Makoto Shiomi, Tenri (JP); Mitsuhiro Shigeta, Uji (JP)

(73) Assignee: Sharp Kabushiki Kaisha, Osaka (JP)

( * ) Notice: Subject to any disclaimer, the term of this patent is extended or adjusted under 35 U.S.C. 154(b) by 727 days.

(21) Appl. No.: 10/773,227

(22) Filed: Feb. 9, 2004

(65) Prior Publication Data

US 2004/0155893 A1 Aug. 12, 2004

(30) Foreign Application Priority Data

Feb. 10, 2003 (JP) ..... 2003-032893
Jan. 9, 2004 (JP) ..... 2004-004793

(51) Int. Cl.
*G09G 5/10* (2006.01)

(52) U.S. Cl. ..... 345/690; 345/89

(58) Field of Classification Search ..... 345/690, 345/87, 94, 99

See application file for complete search history.

(56) References Cited

U.S. PATENT DOCUMENTS 5,347,294 A * 9/1994 Usui et al. ..... 345/89
5,801,673 A * 9/1998 Shimada et al. ..... 345/100
2002/0033789 A1* 3/2002 Miyata et al. ..... 345/89

FOREIGN PATENT DOCUMENTS

JP 11-352450 12/1999
KR 2002-28781 (A) 4/2002

OTHER PUBLICATIONS

Baek-woon Lee, et al., "TFT-LDC with Sub-10 ms of All Gray Response Time: Dynamic Capacitance Compensation" Nov. 29, 2000.

* cited by examiner

*Primary Examiner*—Amr Awad
*Assistant Examiner*—Yong Sim
(74) *Attorney, Agent, or Firm*—Harness, Dickey & Pierce, P.L.C.

(57) ABSTRACT

An evaluation apparatus of a liquid crystal display device in accordance with the present invention is provided with a signal section for supplying a signal to a liquid crystal panel to be evaluated; a display detection section for sensing a display state on the liquid crystal panel; an analysis section for analyzing a detection result of the display detection section. The signal section supplies to the liquid crystal panel a signal corresponding to an original tone and then, in accordance with tone transition from the original tone to an attainment tone, either (i) an overshoot test signal or (ii) both an overshoot test signal and an undershoot test signal in test driving, while sweeping either a level of the signal (i) or levels of both the signals (ii). The analysis section analyzes detection results of the display detection section obtained in the test driving and stores in association with the original tone and the attainment tone, a level of the test signal that corresponds to an optimum one of the detection results. With this, it is possible to easily and highly accurately obtain an optimum level of the overshoot signal or the undershoot signal for the liquid crystal panel to be evaluated.

13 Claims, 13 Drawing Sheets

EVALUATION APPARATUS OF LIQUID CRYSTAL DISPLAY DEVICE, LIQUID CRYSTAL DISPLAY DEVICE, AND EVALUATION METHOD OF LIQUID CRYSTAL DISPLAY DEVICE

This Nonprovisional application claims priority under 35 U.S.C. § 119(a) on Patent Application No. 2003/32893 filed in Japan on Feb. 10, 2003 and Patent Application No. 2004/4793 filed in Japan on Jan. 9, 2004, the entire contents of which are hereby incorporated by reference.

FIELD OF THE INVENTION

The present invention relates to an evaluation apparatus of a liquid crystal display device, a liquid crystal display device mounting a drive circuit which uses an overshoot parameter that is obtained through evaluation by the evaluation apparatus, and an evaluation method of a liquid crystal display device, for example. The evaluation particularly relates to evaluation appropriately performed for evaluating a response characteristic.

BACKGROUND OF THE INVENTION

In these years, flat panel displays (FPDs) have been remarkably developed and have been replacing cathode-ray tube monitors. Liquid crystal displays (LCDs) which are the pioneer of the FPDs, in particular, have made remarkable technological progress enough to be commonly used in our daily lives, and their development is further expected.

However, LCDs still have major disadvantages. A typical example of the disadvantages is that LCDs are not good at displaying moving images. This is partly because the response speed of liquid crystal is low. The response speed of liquid crystal has been typically considered as the speed of switching between black and white. In such circumstances as LCDs have been replacing cathode-ray tube monitors, however, switching between halftone level and halftone level is important. Therefore the response speed of liquid crystal should be considered as the speed of the halftone-halftone switching. Moreover, the response speed is generally lower in the halftone-halftone switching than in the black and white switching, thus causing a problem.

Increasing the response speed is thus indispensable for applying LCDs, instead of cathode-ray tube displays, to televisions. The major issue is accordingly how to increase the response speed of liquid crystal with respect to switching between any tones. One of the means to solve the problem is an Overshoot (OS) driving method. FIG. 12 shows an example of the OS driving method. When the tone level of liquid crystal is switched from A to B, the switching speed of liquid crystal is generally higher if a tone level difference between A and B is larger.

Namely, in rise response where A<B as shown in FIG. 12, the switching speed of liquid crystal can be higher than the normal speed of switching from A to B, by instantly inputting an OS tone level C which is higher than B and then inputting the target tone level B. Further, in decay response where A>B, the switching speed of liquid crystal can be higher than the normal speed of switching from A to B, by instantly inputting an OS tone level C which is lower than B and then inputting the target tone level B.

Practically, the switching speed of liquid crystal is highest in full tone switching (for example, switching from 0 tone to 255th tone). Thus, in the OS driving method, the response speed of liquid crystal with respect to switching between any tones can be theoretically increased to the response speed in the full tone switching. It is thus possible to obtain an LCD capable of achieving sufficiently high response speed with respect to switching between any tones by applying the OS driving method to a liquid crystal display mode where the response speed in the full tone switching is sufficiently high.

For realizing the OS driving method as described above, a major issue to be carefully considered is how to determine an OS parameter (signal level to be applied as the OS tone level C in actual driving). In a circuit for performing the OS driving, a commonly used algorism is essentially such that "compare a tone in an n field (present tone A) to a tone in an (n+1) field (attainment tone B); refer to a Look-up Table (LUT); and determine an OS parameter C." The LUT is a list which determines C using combination of a value A and a value B, such that "the OS parameter C is 190th tone with respect to 120th tone in an n field and 150th tone in an (n+1) field," for example. If the LUT cannot be accurately determined, the display cannot achieve proper display because of the following conditions.

Namely, if the OS parameter C is properly set, it is possible to achieve an ideal response characteristic which reaches the attainment tone B in one field period without exceeding the attainment tone B, as shown in FIG. 13. On the other hand, if the OS parameter C is set too large in order to obtain sufficiently high response speed, the response waveform of liquid crystal has a corner, as shown in FIG. 14. In such a case, the liquid crystal is overly responding more than the required level of switching. When the LCD in this condition is actually viewed, the LCD unnaturally glares on the occasion of switching and displaying moving images. Further, if the level of the OS parameter C is set too low in order to prevent the overresponse of the liquid crystal, the liquid crystal cannot achieve a sufficient response characteristic (the response waveform does not reach the attainment tone B in one field period), as shown in FIG. 14. As the level of the OS parameter C becomes lower, the response characteristic becomes more and more similar to the response characteristic without the OS driving as shown in FIG. 15, reducing the advantage of the OS driving.

Therefore the OS parameter C is determined by obtaining a capacity change of the cell that occurs in the switching of liquid crystal and then calculating the OS parameter C using the capacity change of the cell, in a typical conventional technique as shown in Japanese Unexamined Patent Publication No. 352450/1999 (Tokukaihei 11-352450; published on Dec. 24, 1999).

Further, a method to estimate the OS parameter C using response waveform in normal driving has been devised as described below.

1. Response waveform between tones in the normal driving method is measured.

2. The tone level attained after a period corresponding to the application of an OS signal is obtained from the waveform.

3. With this result, an LUT is created by estimating the OS parameter C required for the switching between the tones.

If the OS parameter C is calculated using the capacity change, however, the response does not take into account the influence of the viscosity of liquid crystal at all. This often causes a large difference between the calculation result and the actually required OS parameter C. Namely, the OS parameter should be uniquely determined depending on the thickness and shape of the cell, liquid crystal material, and the like. In practice, however, the OS parameter has a large error of not less than 30% in some portion. Since the user had lower tolerance level with respect to error in the parameter, a certain degree of error in the parameter had been permitted as long as liquid crystal whose response is slow can respond at a speed barely enough to display moving images. However, since the tolerance level with respect to error in the parameter has become extremely higher because high-speed response as well as a finer image quality has been required, the conventional method has become insufficient for obtaining the OS parameter C having a small error.

Further, though the method to estimate the OS parameter C using the response waveform satisfies all required conditions, this method is complicated because it is required to check the waveform by performing the OS driving using the created LUT, in order to correctly determine the OS parameter C. Further, if the waveform needs to be adjusted as a result of the checking, the estimation and measurement for the checking need be repeated many times, thus requiring much labor.

SUMMARY OF THE INVENTION

The present invention has an objective to provide an evaluation apparatus of a liquid crystal display device, a liquid crystal display device, and an evaluation method of a liquid crystal display device, which can obtain an optimum overshoot parameter with ease and high accuracy.

In order to solve the foregoing problem, an evaluation apparatus of a liquid crystal display device of the present invention is arranged so as to include a signal section for supplying a signal to a liquid crystal panel to be evaluated; a display detection section for sensing a display state of the liquid crystal panel (detecting a display state of the liquid crystal panel); and an analysis section for analyzing a detection result of the display detection section, the signal section sequentially supplying to the liquid crystal panel (i) a signal corresponding to an original tone (A), (ii) an overshoot signal, and (iii) a signal corresponding to an attainment tone (B) in this order in test driving, while sweeping a level of the overshoot signal, the analysis section analyzing detection results of the display detection section. obtained in the test driving and storing in association with the original tone (A) and the attainment tone (B), a level of the overshoot signal that corresponds to an optimum one of the detection results in accordance with analysis results.

First, the overshoot (OS) signal is either a signal whose level is higher than the level of the signal corresponding to the attainment tone (B) (in rise response where the original tone A<the attainment tone B), or a signal whose level is lower than the signal corresponding to the attainment tone (B) (in decay response where the original tone A>the attainment tone B).

With this arrangement, the signal section performs test driving (test OS driving) for sequentially supplying to the liquid crystal panel the signal corresponding to the original tone (A), the overshoot signal, and the signal corresponding to the attainment tone (B), while varying (sweeping) the level of the overshoot signal.

As a result, the liquid crystal panel to be evaluated shows display corresponding to each overshoot signal (level), and the display detection section senses (detects) the display (display state). The analysis section then analyzes detection results so as to find out an optimum one of the detection results in a case where the original tone is A and the attainment tone is B, and a level of the overshoot signal corresponding to the optimum one of the detection results is stored in association with the original tone A and the attainment tone B.

As described above, with this arrangement, test driving (test OS driving) is actually performed on a liquid crystal panel to be evaluated so as to evaluate the display property of the liquid crystal panel. With this, it is possible to perform so-called direct finding-out and storing of the optimum level of the overshoot signal in accordance with each liquid crystal panel.

In other words, it is possible to simplify the evaluation steps and easily obtain the optimum level of the overshoot signal with high accuracy without significantly affected by the panel characteristic and detection error, compared with a conventional evaluation apparatus which determines a tentative level of the overshoot signal based on the waveform in normal driving, etc., and then checks and modifies the tentative overshoot signal through performing the OS driving based on the tentative overshoot signal.

For a fuller understanding of the nature and advantages of the invention, reference should be made to the ensuing detailed description taken in conjunction with the accompanying drawings.

BRIEF DESCRIPTION OF THE DRAWINGS

FIG. 9(*b*) is a graph showing relationship between a response time from 0 tone to 255th tone and an undershoot signal level.

DESCRIPTION OF THE EMBODIMENTS

The following will explain an embodiment of the present invention with reference to FIGS. 1 through 6 and FIGS. 12 through 16.

Figure 1:
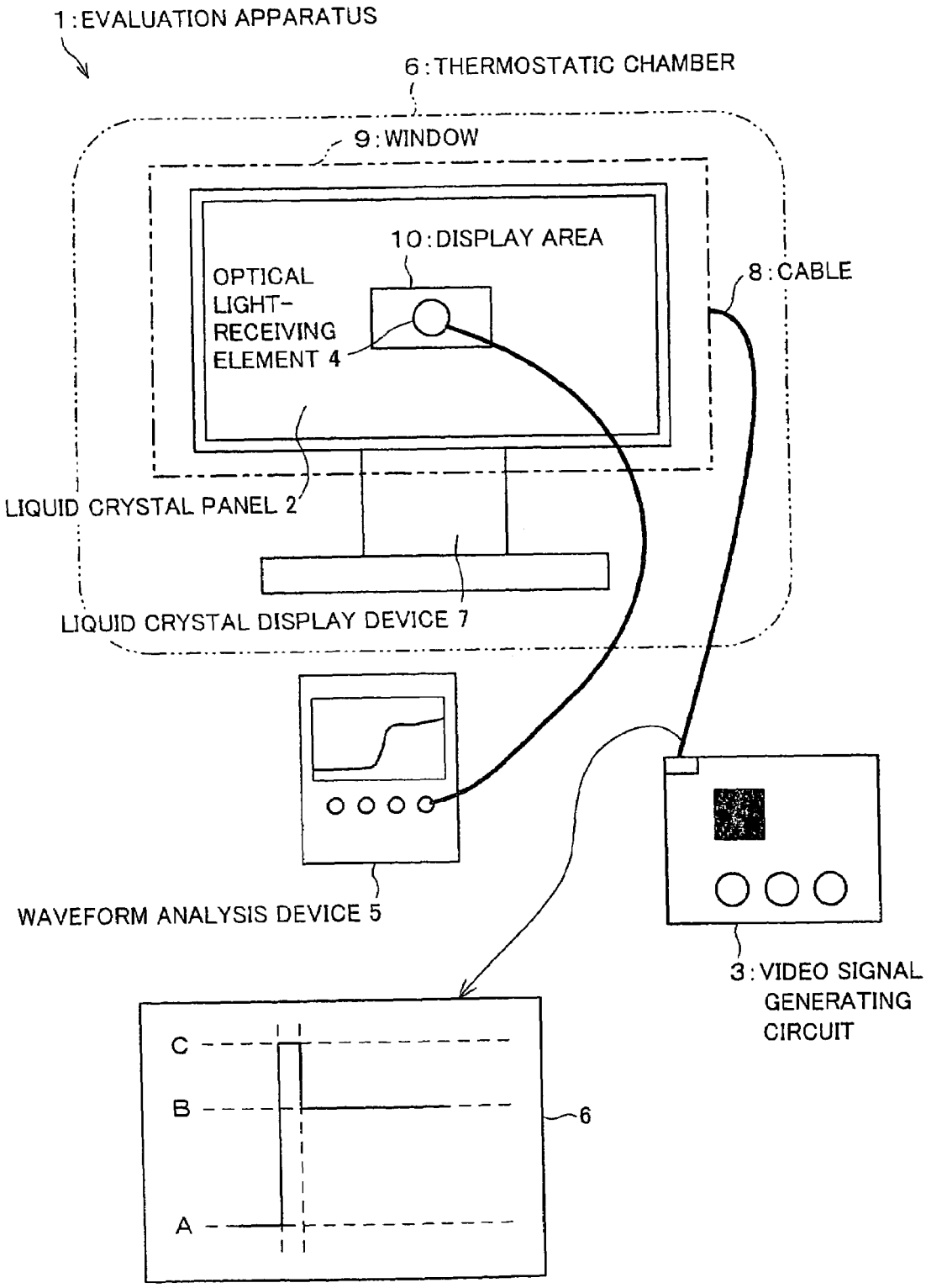
FIG. 1 is a diagram showing an overall arrangement of an evaluation apparatus in accordance with an embodiment of the present invention.

FIG. 1 shows an overall arrangement of an evaluation apparatus 1 in accordance with an embodiment of the present invention. The evaluation apparatus 1 is arranged to include a video signal generating circuit 3 (signal section) which supplies an OS-driven video signal to a liquid crystal panel 2 to be evaluated, an optical receiving element 4 (display detection section) facing a display section of the liquid crystal panel 2, a waveform analysis device 5 (analysis section) to which an output from the optical light-receiving element 4 is supplied, a thermostatic chamber 6, and a control device (not shown).

The control device causes the video signal generating circuit 3 to output to the liquid crystal panel 2 a video signal whose level changes from A to C, then from C to B while sweeping the OS signal level C (level of an overshoot signal), as indicated in the reference mark 6 (test driving, test OS driving). Here, A corresponds to a tone before being changed (original tone), B corresponds a tone to be attained (attainment tone), and C is an OS signal level (including a case where C=B). Then, after subjected to photo-electric conversion by the optical light-receiving element 4, response waveforms (detection results of the display detection section) are analyzed by the waveform analysis device 5. With respect to these response waveforms, an OS signal level that realizes a response waveform which reaches the attainment tone B fastest without overresponse is stored in an LUT as an OS parameter C (level of an overshoot signal corresponding to an optimum output waveform) in association with the tone before being changed A and the attainment tone B. With this LUT, a drive circuit (overshoot drive circuit) of the liquid crystal display device 7 OS-drives the liquid crystal panel 2 which is mounted on the liquid crystal display device 7, thereby achieving proper OS driving. Such evaluation is performed by the manufacturer with respect to each of different types of the liquid crystal panel 2 so as to determine the OS parameter C.

Any type of the liquid crystal panel 2 to be applied with the OS driving can be evaluated irrespective of whether or not a controller, etc., of the liquid crystal panel 2 has OS control function, provided that a signal is not converted in the controller, etc. The video signal generating circuit 3 should input a video signal to the liquid crystal panel 2 in accordance with such a method that the liquid crystal panel 2 can output a correct tone in response to the inputted signal. For example, if a video signal is inputted via a video input terminal, the video signal originally having a tone range of from 0 to 255 is converted by the controller into a signal having a tone range of from 16 to 235. Consequently, a signal having a correct tone cannot be supplied to the liquid crystal panel 2.

Therefore, if the liquid crystal panel 2 has a digital input terminal (here, taken as an example is a DVI which is equipped in recent liquid crystal panels), the video signal generating circuit 3 should have a DVI output terminal, and the cable 8 which supplies a video signal from the video signal generating circuit 3 to the liquid crystal panel 2 should be a DVI cable.

On the other hand, if the liquid crystal panel 2 does not have the digital input terminal, the video signal from the video signal generating circuit 3 should be directly supplied to a source driver of the liquid crystal panel 2 because the video signal cannot be properly supplied via the video input terminal, as described earlier. For example, by separating the controller and the source driver which are connected using a flexible substrate, the video signal generating circuit 3 may be sandwiched between the controller and the source driver via the flexible substrate. Specifically, a signal from the controller is picked up by the video signal generating circuit 3 as a clock signal, and the video signal from the video signal generating circuit 3 is directly supplied to the source driver.

The waveform analysis device 5 picks up and analyzes the response waveform of the liquid crystal panel 2. The response waveform is sent from the optical light-receiving element 4 to the waveform analysis device 5. The waveform analysis device 5 is generally an oscilloscope, but may be a computer constituting the control device so that the computer directly picks up the response waveform.

The thermostatic chamber 6 can contain at least the liquid crystal display device 7. As shown in FIG. 1, the thermostatic chamber 6 may contain the optical light-receiving element 4 together with the liquid crystal panel 2. Alternatively, the thermostatic chamber 6 may contain only the liquid crystal panel 2, and is provided with a window 9 through which the display section of the liquid crystal panel can be observed from the outside. With this, the display results can be observed by providing the optical light-receiving element 4 at the window 9, for example. The temperature in the thermostatic chamber 6 is controlled by the control device, etc., so as to fall within a range of from 0° C. to 60° C., for example.

By providing the thermostatic chamber 6, the liquid crystal panel 2 can be evaluated under a constant temperature. Further, the liquid crystal panel 2 can be evaluated under various environment temperatures so that the optimum OS parameter C can be obtained with respect to each of the temperatures. This realizes detailed OS driving such that an LUT with respect to several temperatures is stored in the drive circuit of the liquid crystal panel 2, and the LUT is selectively referred in accordance with a result sensed by a temperature sensor which is provided to the liquid crystal panel 2.

Further, if the temperature in the thermostatic chamber 6 largely changes, the application of such a harsh temperature cycle may overload parts constituting the liquid crystal panel 2. This may cause a defect in lighting though infrequently.

Thus, by providing the window 9 to the thermostatic chamber 6, the measurer can promptly find the defect, thereby easily taking measures against the defect.

As shown in FIG. 1, the video signal generating circuit 3, the waveform analysis device 5, and the control device are provided outside the thermostatic chamber 6 and controlled by direct switch operation of the measurer. But the video signal generating circuit 3, the waveform analysis device 5, and the control device may be provided inside the thermostatic chamber 6 so as to be operated from the outside of the thermostatic chamber 6 using a remote controller, and the like.

Figure 2:
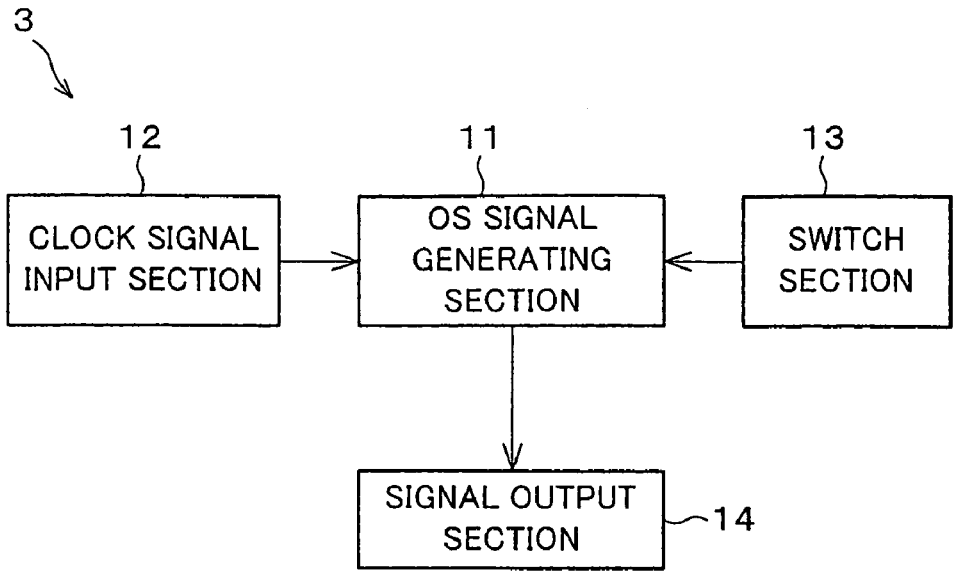
FIG. 2 is a block diagram showing an example of an arrangement of a video signal generating circuit in the evaluation apparatus shown in FIG. 1.

FIG. 2 is a block diagram showing an arrangement of the video signal generating circuit 3. The video signal generating circuit 3 is arranged to include an OS signal generating section 11, a clock signal input section 12, a switch section 13, and a signal output section 14. In response to a clock signal sent from the clock signal input section 12, the OS signal generating section 11 generates a video signal in accordance with the signal levels A, B, and C that are set at the switch section 13. Namely, the OS signal generating section 11 generates a video signal whose vertical scanning frequency is 60 Hz if a signal whose vertical scanning frequency is 60 Hz such as NTSC is supplied to the OS signal generating section 11, and generates a video signal whose vertical scanning frequency is 50 Hz if a signal whose vertical scanning frequency is 50 Hz such as PAL is supplied to the OS signal generating section 11. As described later, the switching section 13 is composed of three switch systems for individually controlling the levels A, B, and C of the video signal. By digitally controlling (turning ON/OFF) the three switch systems, the switch section 13 sequentially outputs as the video signal, voltages corresponding to how the three switch systems are turned ON or OFF. The video signal generated at the OS signal generating section 11 is supplied to the signal output section 14, and then supplied to the liquid crystal panel 2 via the connecting cable 8.

Figure 12:
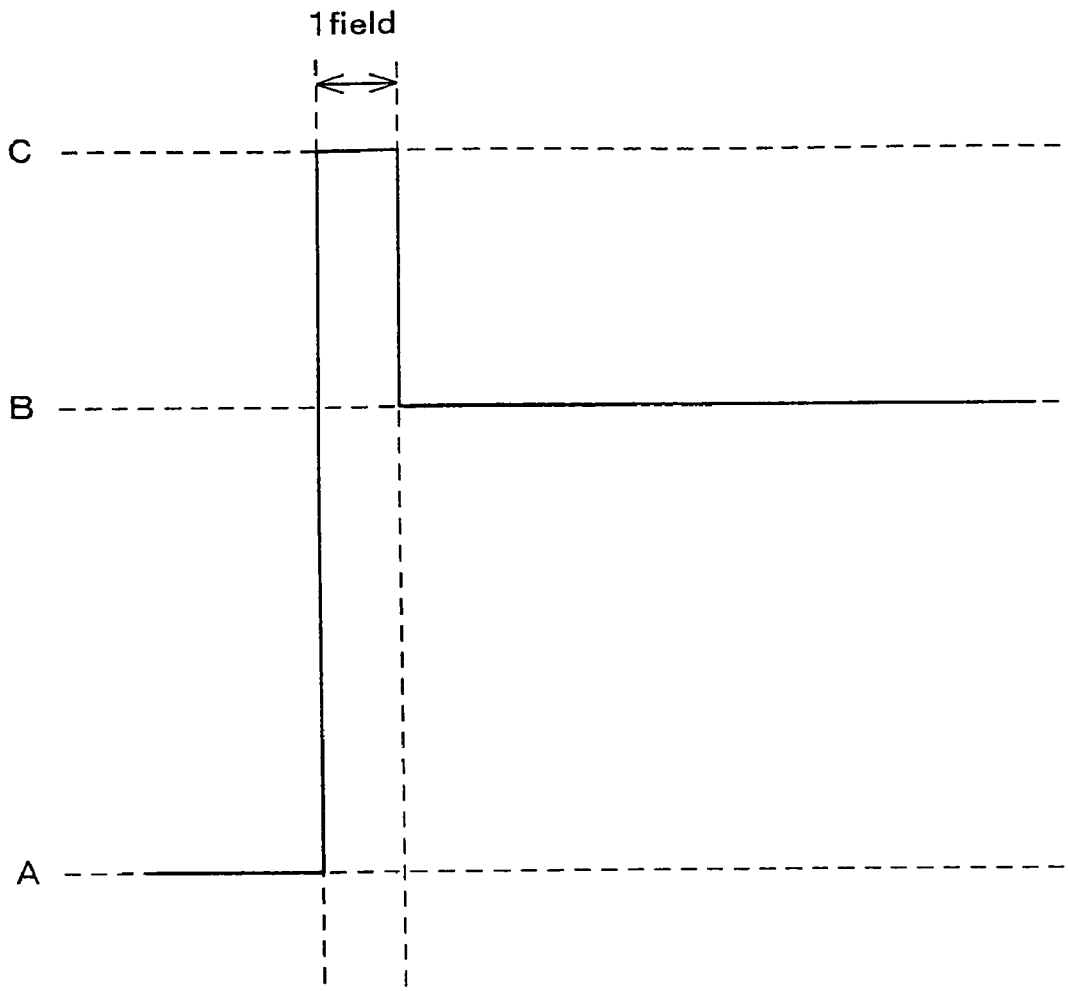
FIG. 12 is a waveform chart showing an example of a signal for switching in one-field overshoot driving.

The switch section 13 which inputs a parameter required for determining the OS signal level is realized by a personal computer, etc., but may be replaced by an input from the control device which controls the total evaluation apparatus 1. The switch section 13 is composed of the aforesaid three switch systems if the video signal consists of the three signal levels A, B, and C, as shown in FIG. 12. If a switch system for setting the finest OS signal level C is an 8-bit switch system, which expresses 256 tones, for example, the switch systems for the tone before being changed A and the tone to be attained B are respectively 4-bit switch systems. The 4-bit switch systems respectively realize tone switching by a unit of 16 tones.

It is desirable that the LUT is set with respect to every tone for switching because it is ideal that the OS signal level is set in detail with respect to any tone switching. In reality, there is often a constraint on the size of the operation program and LUT, because too large IC and memory cannot be used to incorporate the LUT in the OS drive circuit due to the cost of the IC and memory. Therefore the actual LUT is set with respect to the unit of sixteen tones of A and B as described above, and an interpolation algorism is used to calculate remaining values. Of course, if the constraint on the IC and memory is insignificant, the LUT may be set with respect to every tone of A and B. Accordingly, tone levels A and B should be switched by the unit of at least sixteen tones, and preferably with respect to every tone (by a unit of one tone). On the other hand, the OS signal level C should be switched every tone because a change of one tone varies the OS effect. For these reasons, the switch systems respectively have the bit numbers as described above.

By allowing the three signal levels A, B, and C to be respectively adjusted by independent switches, it is possible to set the required OS signal level C simply and precisely without increasing the switches for the tones A and B.

Further, each of the switch systems is composed of two types of switches respectively for coarse adjustment and fine adjustment. For example, in a simple case, the OS signal level C has a total of 8 bits whose upper 4 bits and lower 4 bits are independently controlled by different switches. Here, first, the OS signal level C is roughly estimated by turning ON and OFF the switches for the upper 4 bits (coarse adjustment), and then the OS signal level C is precisely determined by turning ON and OFF the switches for the lower 4 bits (fine adjustment). With this, the OS signal level C can be determined in a short period with high accuracy, out of 256 levels as described earlier, for example.

Further, a time for applying the OS signal level C must conform to the specification of an actual OS drive circuit. For example, in the drive circuit for 60 Hz driving using a signal such as NTSC, the time for applying the OS signal is 16 msec, because one field period lasts for 16 msec. Further, when the OS signal is applied over a plurality of fields as described later, the time for applying the OS signal is expressed as follows.

(number of fields in which the OS signal is supplied)×
(16 msec)

Likewise, in the drive circuit for 50 Hz driving using a signal such as PAL, one field period lasts for 20 msec. Here, the time for applying the OS signal is expressed as follows.

(number of fields in which the OS signal is supplied)×
(20 msec)

In a special drive circuit such as a double speed driving circuit which doubles the frame frequency, the time for applying the OS signal may be calculated using one field period of the special drive circuit. For the drive frequency of the drive circuit, it is easy to use the clock of a video signal such as NTSC and PAL which is supplied from the outside. In a special condition such as the double speed driving, a required clock may be created based on the clock of the input video signal. Of course, in any case, the clock signal input section 12 may create the clock inside the circuit without an input from the outside, and selectively use the clock using a switch provided to the circuit.

Figure 3:
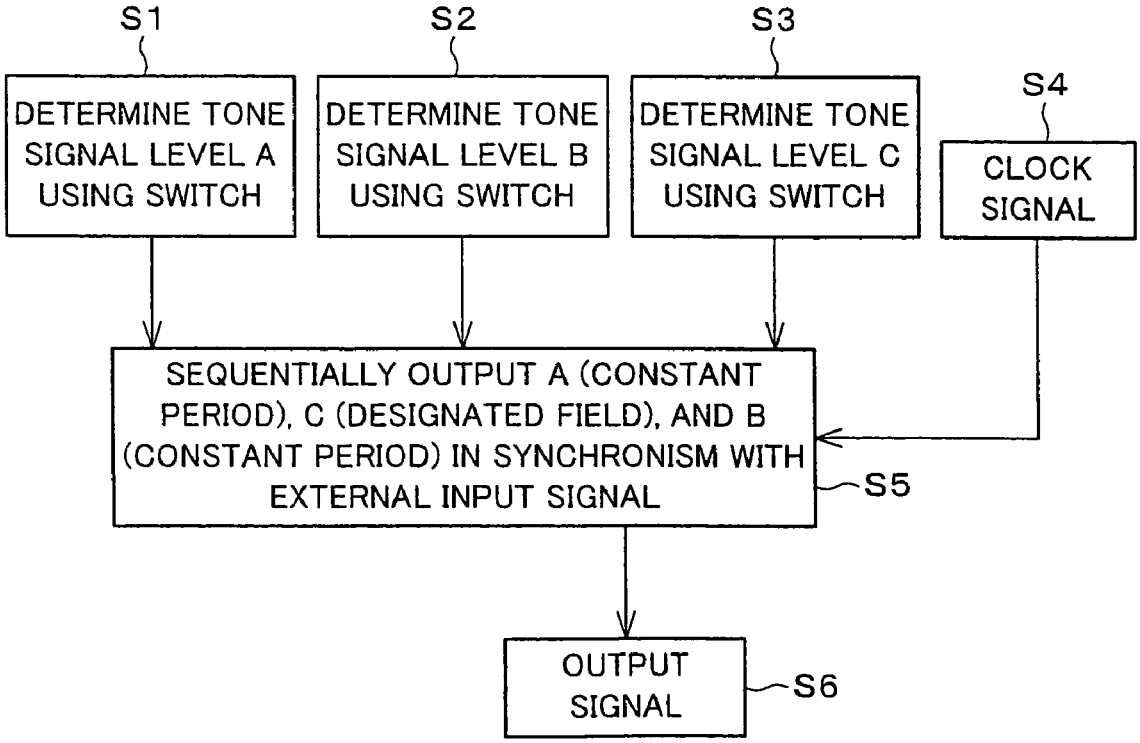
FIG. 3 is a flow chart used for explaining the operation of generating a video signal for one-field overshoot driving.

FIG. 3 is a flow chart used for explaining the operation of generating the video signal as shown in FIG. 12. The switch systems corresponding to the three signal levels A, B, and C set the signal level in the steps S1 through S3, respectively. In a step S4, the clock signal input section 12 supplies a clock signal to the OS signal generating section 11. In a step S5, in response to the clock signal, the OS signal generating section 11 generates the video signal whose level sequentially changes from A to C, then C to B which are the levels set by the switch systems. A signal whose level is the tone before being changed A is outputted for a predetermined constant period, a signal having the OS signal level C is outputted for one field period, and a signal whose level is the attainment tone B is outputted for a predetermined constant period. Then, in a step S6, the signal output section 14 outputs these signals to the liquid crystal panel 2.

A part of or all of the display area on the liquid crystal panel 2 (FIG. 1 shows a case of a part of the display area as indicated by the reference mark 10) performs display operation using the video signal. A display result is picked up by the optical light-receiving element 4, and then analyzed by the waveform analysis device 5. Then, the steps S1 through S6 are repeated with respect to other OS signal levels C. A result of the analysis is picked up by the control device (not shown), etc. With this, the optimum OS parameter C is determined with respect to each of the tones A and B, so that the LUT is created.

FIGS. 13 through 16 show examples of an optical response waveform of the liquid crystal panel 2 when the video signal shown in FIG. 12 is used for switching. Here, after picked up by a photodiode as the optical light-receiving element 4, the optical response waveform is analyzed by an oscilloscope as the waveform analysis device 5, where the temperature in the thermostatic chamber 6 is constantly 25° C. In the cases shown in FIGS. 13 through 16, the tone before being changed A and the attainment tone B are constantly 64th tone and 192nd tone, respectively.

Figure 13:
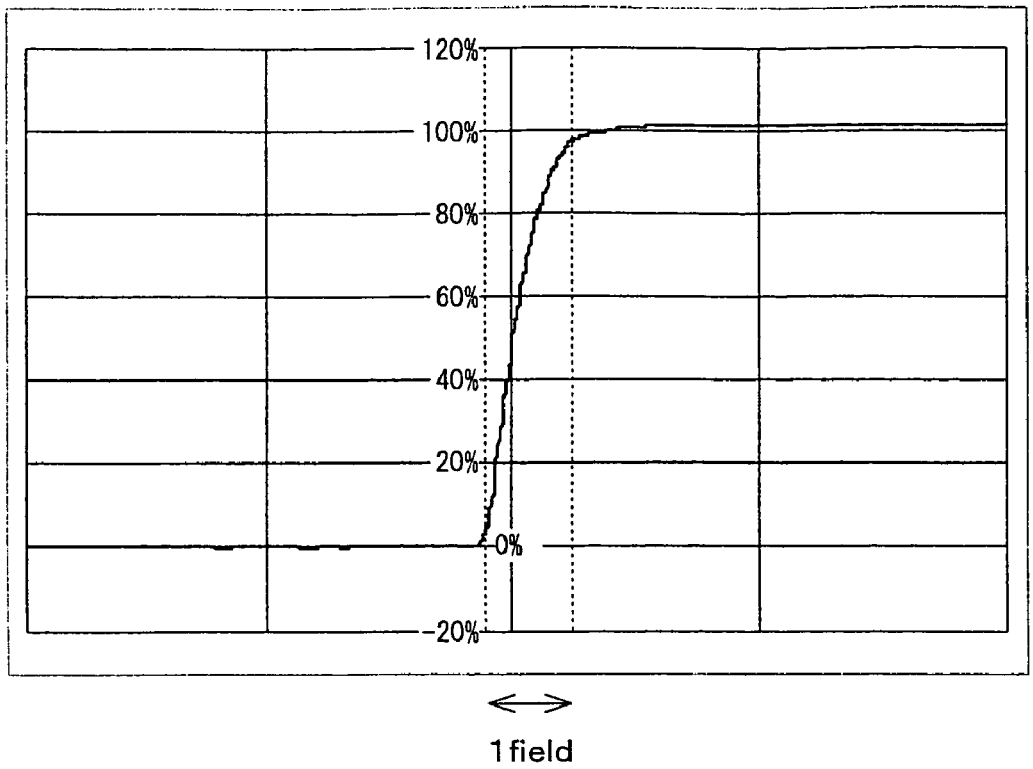
FIG. 13 is an optical response waveform of a liquid crystal panel with respect to switching when overshoot driving is performed using a proper overshoot signal.
Figure 14:
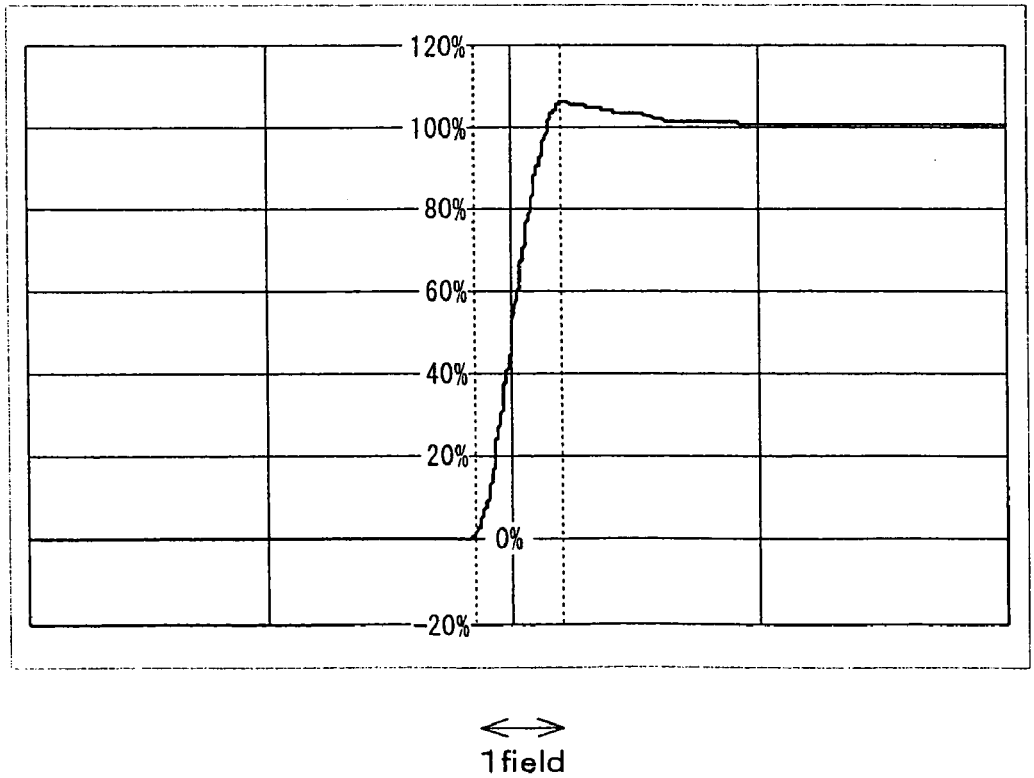
FIG. 14 is an optical response waveform of a liquid crystal panel with respect to switching when overshoot driving is performed using an excessive overshoot signal.
Figure 15:
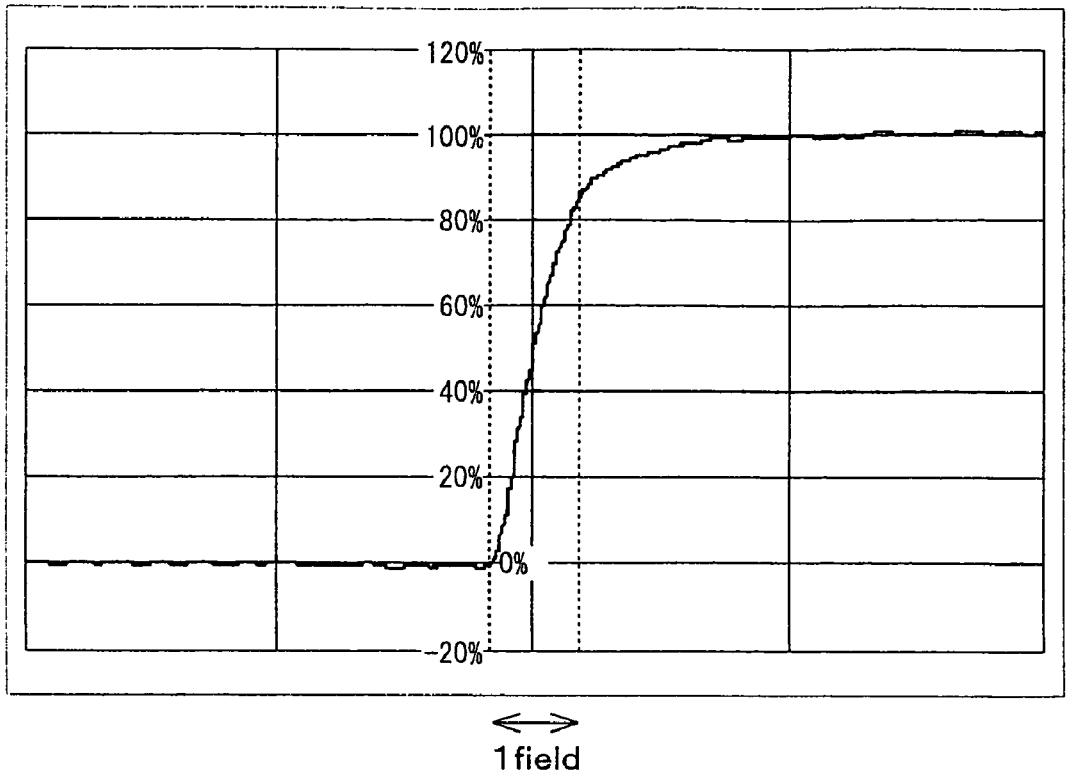
FIG. 15 is an optical response waveform of a liquid crystal panel with respect to switching when overshoot driving is performed using a weak overshoot signal.
Figure 16:
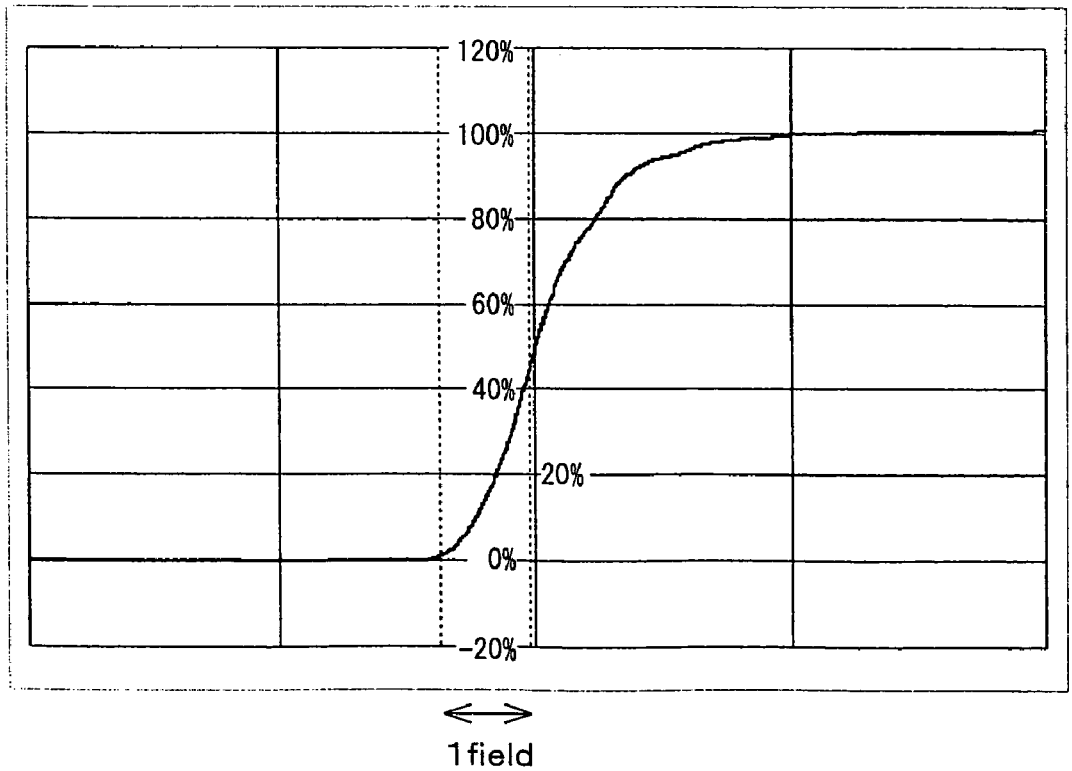
FIG. 16 is an optical response waveform with respect to switching when overshoot driving is not performed.

First, FIG. 16 is a waveform where the OS driving is not performed, namely where the OS signal level C is identical to the attainment tone B. If the OS signal level C is raised a little, the response waveform is slightly influenced by the OS driving, as shown in FIG. 15. If the OS signal level C is further raised, the response waveform is sufficiently influenced by the OS driving, as shown in FIG. 13. If the OS signal level C is further raised, a response waveform starts to have a corner, as shown in FIG. 14. Here, the response waveform exceeds the attainment tone B. Thus, directly before displaying the target tone, the liquid crystal panel 2 appears to unnaturally glare to be whitish. The OS signal level is judged to be optimum at a level directly before causing the overresponse, namely at a level that causes the response waveform as shown in FIG. 13.

Table 1 shows an example of the OS parameter C with respect to tones A and B, which is determined by the method as described above. By storing the LUT of Table 1 in the controller of the liquid crystal panel 2, the OS driving can be optimally performed with respect to switching between any tones including halftone-halftone switching.

TABLE 1

| START | ATTAINMENT TONE | | | | | | | | |
|---|---|---|---|---|---|---|---|---|---|
| TONE | 0 | 32 | 64 | 96 | 128 | 160 | 192 | 224 | 255 |
| 0 | 0 | 125 | 168 | 193 | 213 | 225 | 234 | 247 | 255 |
| 32 | 0 | 32 | 104 | 138 | 176 | 198 | 221 | 240 | 255 |
| 64 | 0 | 15 | 64 | 113 | 160 | 188 | 216 | 238 | 255 |
| 96 | 0 | 9 | 35 | 96 | 148 | 181 | 212 | 237 | 255 |
| 128 | 0 | 5 | 17 | 57 | 128 | 170 | 206 | 234 | 255 |
| 160 | 0 | 4 | 12 | 32 | 114 | 160 | 200 | 232 | 255 |
| 192 | 0 | 3 | 9 | 22 | 99 | 147 | 192 | 228 | 255 |
| 224 | 0 | 2 | 7 | 15 | 77 | 133 | 185 | 224 | 255 |
| 255 | 0 | 0 | 4 | 10 | 47 | 117 | 174 | 218 | 255 |

Further, Table 2 shows results of calculating an attainment ratio of the response waveform at the end of the field in which the OS parameter C having the optimum signal level shown in Table 1 is supplied. Table 2 clearly shows that the attainment ratio is approximately 100% with respect to almost all tones. This confirmed that the supplied OS signal has the necessary and sufficient level.

TABLE 2

| START | ATTAINMENT TONE | | | | | | | | |
|---|---|---|---|---|---|---|---|---|---|
| TONE | 0 | 32 | 64 | 96 | 128 | 160 | 192 | 224 | 255 |
| 0 | | 97.08 | 98.88 | 97.88 | 97.89 | 97.63 | 99.18 | 97.71 | 80.64 |
| 32 | 96.71 | | 89.29 | 96.02 | 99.38 | 97.7 | 97.48 | 98.53 | 88.14 |
| 64 | 97.36 | 94.03 | | 98.67 | 98.99 | 99.06 | 98.44 | 98.98 | 90.35 |
| 96 | 97.11 | 97.98 | 99.3 | | 100.6 | 99.88 | 98.49 | 99.7 | 91.57 |
| 128 | 97.19 | 99.43 | 99.08 | 97.64 | | 98.79 | 98.12 | 97.92 | 91.14 |
| 160 | 97.52 | 98.16 | 98.53 | 97.67 | 97.52 | | 97.18 | 98.42 | 91.34 |
| 192 | 97.07 | 97.02 | 96.71 | 95.86 | 94.71 | 93.83 | | 98.05 | 91.54 |
| 224 | 96.52 | 96.57 | 95.92 | 95.16 | 94.19 | 95.15 | 95.84 | | 92.25 |
| 255 | 96.2 | 97.8 | 97.34 | 95.89 | 95.36 | 96.02 | 97.95 | 98.57 | |

Table 3 shows another LUT as a comparative example where the response waveform of the liquid crystal panel 2 is measured in the normal driving method as described in Background of the Invention. Here, the tone attainment ratio after a time corresponding to the number of fields in which the OS signal is applied (one field in the above example) since a trigger point is calculated, and the OS parameter C is calculated based on the calculation results. Further, as in Table 2, Table 4 shows an attainment ratio of the response waveform in the field in which the OS signal is supplied. This attainment ratio is calculated in the OS driving using the LUT in Table 3.

TABLE 3

| START | ATTAINMENT TONE | | | | | | | | |
|---|---|---|---|---|---|---|---|---|---|
| TONE | 0 | 32 | 64 | 96 | 128 | 160 | 192 | 224 | 255 |
| 0 | 0 | 115 | 168 | 195 | 210 | 224 | 233 | 247 | 255 |
| 32 | 0 | 32 | 121 | 159 | 185 | 209 | 224 | 243 | 255 |
| 64 | 0 | 12 | 64 | 126 | 164 | 193 | 217 | 240 | 255 |
| 96 | 0 | 9 | 31 | 96 | 145 | 181 | 211 | 237 | 255 |
| 128 | 0 | 6 | 20 | 70 | 128 | 171 | 206 | 235 | 255 |
| 160 | 0 | 3 | 13 | 46 | 108 | 160 | 200 | 232 | 255 |
| 192 | 0 | 0 | 11 | 27 | 82 | 144 | 192 | 228 | 255 |
| 224 | 0 | 0 | 8 | 15 | 54 | 123 | 181 | 224 | 255 |
| 255 | 0 | 0 | 5 | 12 | 31 | 102 | 171 | 218 | 255 |

TABLE 4

| START | ATTAINMENT TONE | | | | | | | | |
|---|---|---|---|---|---|---|---|---|---|
| TONE | 0 | 32 | 64 | 96 | 128 | 160 | 192 | 224 | 255 |
| 0 | | 56.38 | 72.65 | 93.77 | 79 | 93.2 | 83.45 | 90.12 | 84.07 |
| 32 | 97.16 | | 125.9 | 136.9 | 116 | 116 | 100.1 | 97.36 | 88.18 |
| 64 | 97.35 | 95.06 | | 137.4 | 102.7 | 104.7 | 96.97 | 100.9 | 90.45 |
| 96 | 97.64 | 100.1 | 103.6 | | 87.27 | 94.14 | 91.83 | 97.65 | 91.51 |
| 128 | 97.94 | 100.4 | 93.39 | 85.95 | | 89.52 | 93.03 | 95.03 | 91.77 |
| 160 | 97.97 | 102.1 | 96.13 | 90.48 | 105.2 | | 94.88 | 98.6 | 91.76 |
| 192 | 97.77 | 100.3 | 97.57 | 92.55 | 102.2 | 96.57 | | 94.7 | 92.15 |
| 224 | 97.33 | 99.31 | 94.71 | 96.61 | 99.71 | 102.5 | 106.3 | | 91.88 |
| 255 | 96.75 | 98.01 | 97.21 | 93.9 | 97.96 | 102.6 | 102.1 | 101.1 | |

As is clear from the comparison between Tables 1 and 3 and the comparison between Tables 2 and 4, the LUT in the conventional technique often includes combination of tones whose attainment ratio during the period for applying the OS signal is far less than 100% because the OS signal does not have a sufficient level as shown in FIG. 15. Further, the LUT in the conventional technique often includes combination of tones whose attainment ratio during the period for applying the OS signal is over 100% because the OS signal level is too high as shown in FIG. 14. Thus, the LUT in the conventional technique is not complete.

Figure 4:
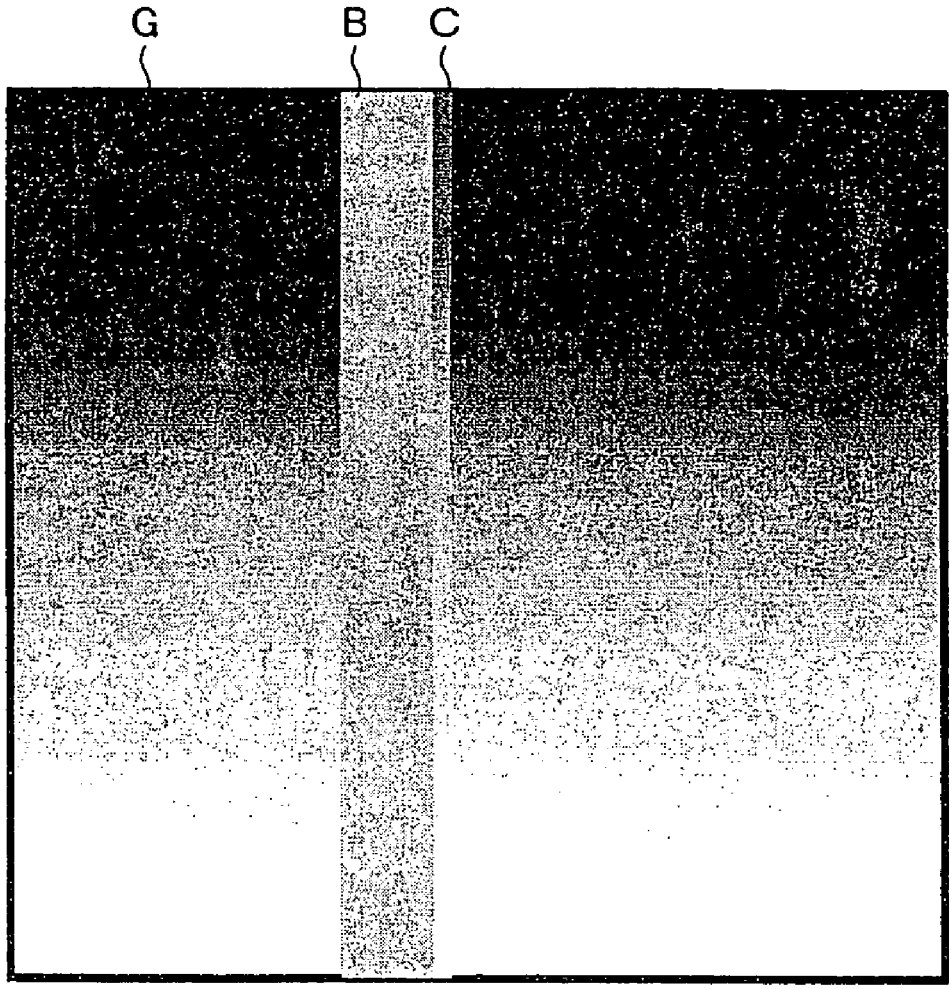
FIG. 4 is a diagram showing -a result of displaying a scroll pattern when a proper LUT is used for overshoot driving.

FIG. 4 shows an example of display results in the OS driving using the LUT of the present invention. In this example, the tone before being changed A is a gray scale G in which the gray scale is black at the uppermost side and becomes gradually whiter toward the lowermost side on the screen. Then, a bar of the attainment tone B which has an appropriate width, attached with a tone of the OS signal C, is scrolled from left to right on the gray scale G. The tone level of the scroll bar is between the maximum tone level (white) and the minimum tone level (black) of the gray scale G.

With the pattern shown in FIG. 4, it is possible to confirm the effect of the OS control such that the scroll bar is kept to have a constant density even if the background is the gray scale G having various tones. Note that, the levels B, C, and G are independently switched by an external circuit. Further, as described earlier, the attainment tone B is switched by the unit of 16 tones, and the OS parameter C is switched with respect to every tone.

Figure 5:
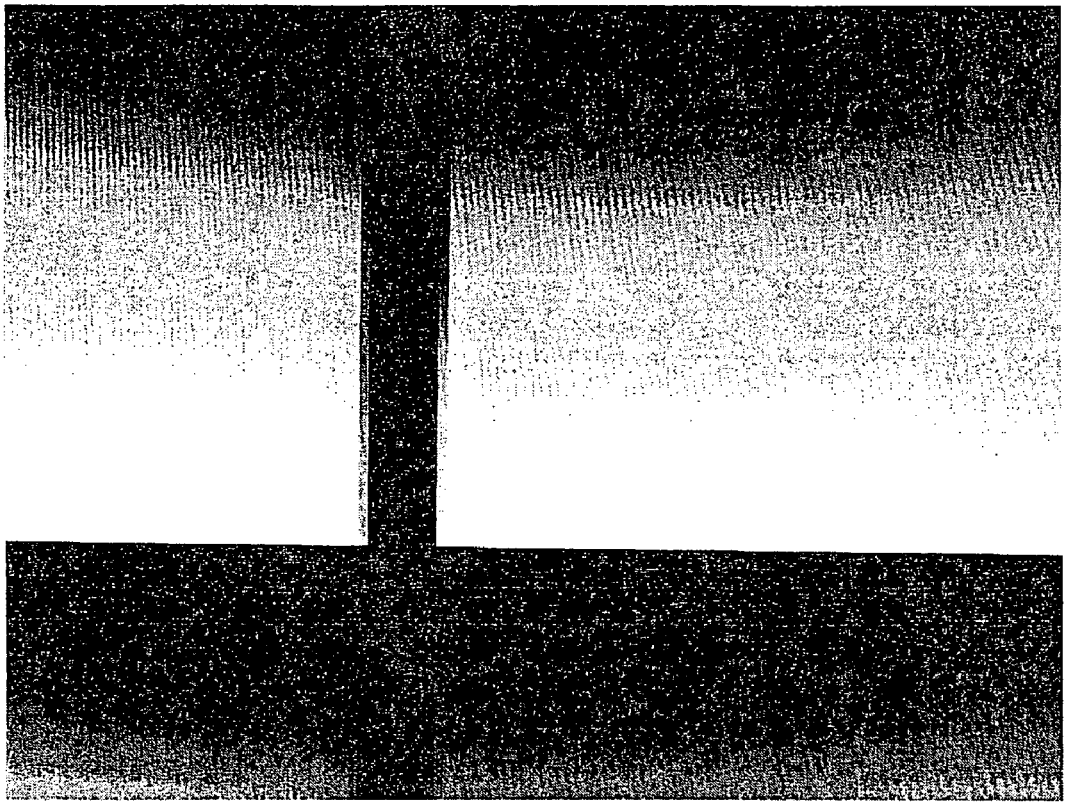
FIG. 5 is an example of a scroll pattern used for checking the effects of overshoot driving.
Figure 6:
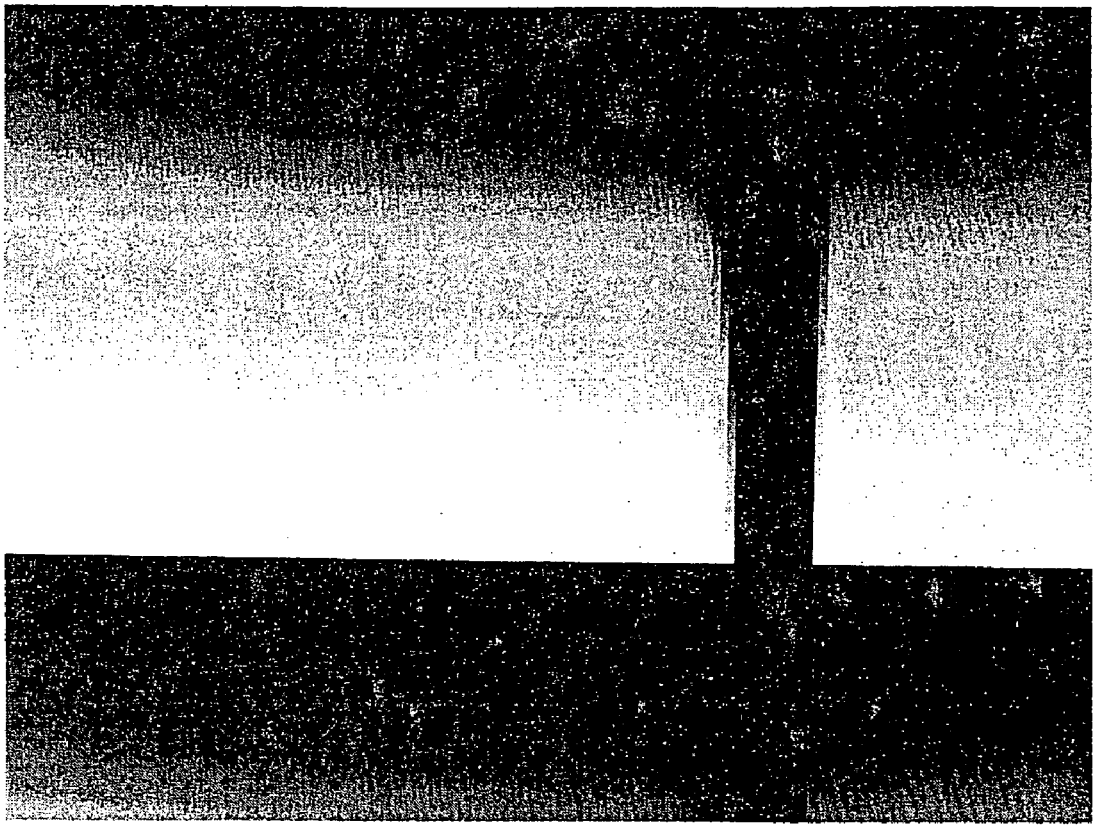
FIG. 6 is a diagram showing a result of displaying a scroll pattern when the overshoot driving is not performed.

Further, FIG. 5 shows display results where the tone of the scroll bar is black which is the minimum tone level. As a comparison example, FIG. 6 shows display results where the OS driving is not performed. As is clear from FIGS. 5 and 6, the image supplied with a proper OS signal allows significantly less blurring phenomenon, and appears natural, compared with the image to which the OS signal is not supplied. The blurring phenomenon remarkably appears when the response is slow. Further, if the OS driving properly works, the bar in any tone is minimally affected by the white glaring (or blackening) due to excess of the OS signal level, and the blurring due to an insufficient OS signal level. The validity of the determined OS parameter can be thus evaluated to a certain degree using the patterns shown in FIGS. 4 through 6.

In this manner, the present invention can obtain the optimum OS parameter C with ease and high accuracy. Further, a liquid crystal panel without the function of OS driving can be also measured using the OS signal. If the OS driving is newly introduced to the liquid crystal panel later, two operations, namely circuit designing and the determination of the OS parameter C, are generally required. In contrast, the present invention can obtain the parameter for the OS driving even if the circuit has not been complete yet, namely even if the OS driving cannot be performed.

Note that, the foregoing explained a case of rise response as shown in FIG. 12, namely a case where A<B. In a case of decay response where A>B, the OS signal level C with respect to given tones A and B is not more than the attainment tone B. Here, the OS parameter C can be correctly determined by observing the response waveform while changing the level C so as to find the minimum level C that does not cause the response waveform to exceed the level B.

Further, an evaluation method of the present invention has the steps of analyzing the response waveform while varying the level of the overshoot signal C with respect to the tone before being changed A (hereinafter referred to as original tone A) and tone to be attained B (hereinafter referred to as attainment tone B); and storing in association with the original tone A and the attainment tone B, a level of the overshoot signal C that realizes a response waveform which reaches a level of the attainment tone B fastest without overresponse, among the response waveforms with respect to the various levels of the overshoot signal C. An overshoot drive circuit storing in a LUT the level of the overshoot signal C obtained by the evaluation method (optimum OS parameter C) can apply to a liquid crystal panel an optimum signal having a necessary and sufficient response characteristic. Namely, a liquid crystal display device (liquid crystal display) having the overshoot drive circuit can achieve an excellent response characteristic and display quality without deteriorating video images.

The following will explain another embodiment of the present invention with reference to FIGS. 7 through 12.

The present embodiment is arranged so that the OS driving is performed in stages or divisionally over n field periods (n is an integer not less than 1), namely over multiple field periods. This OS driving is performed if a desired tone is not easily attained in one field period. Here, the tone is adjusted over several frames so as to attain the final attainment tone B.

Figure 7:
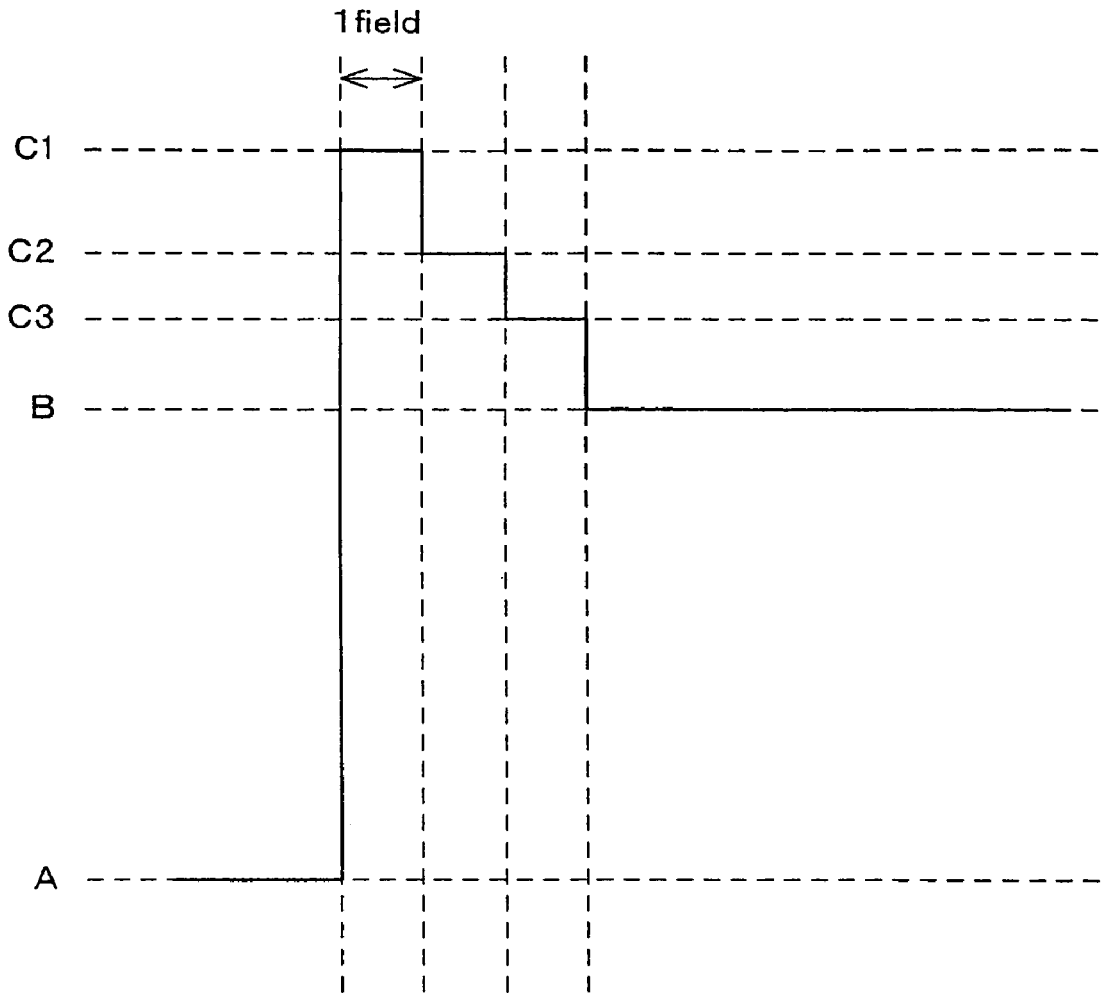
FIG. 7 is a waveform chart showing an example of a signal for switching in three-field overshoot driving.
Figure 8:
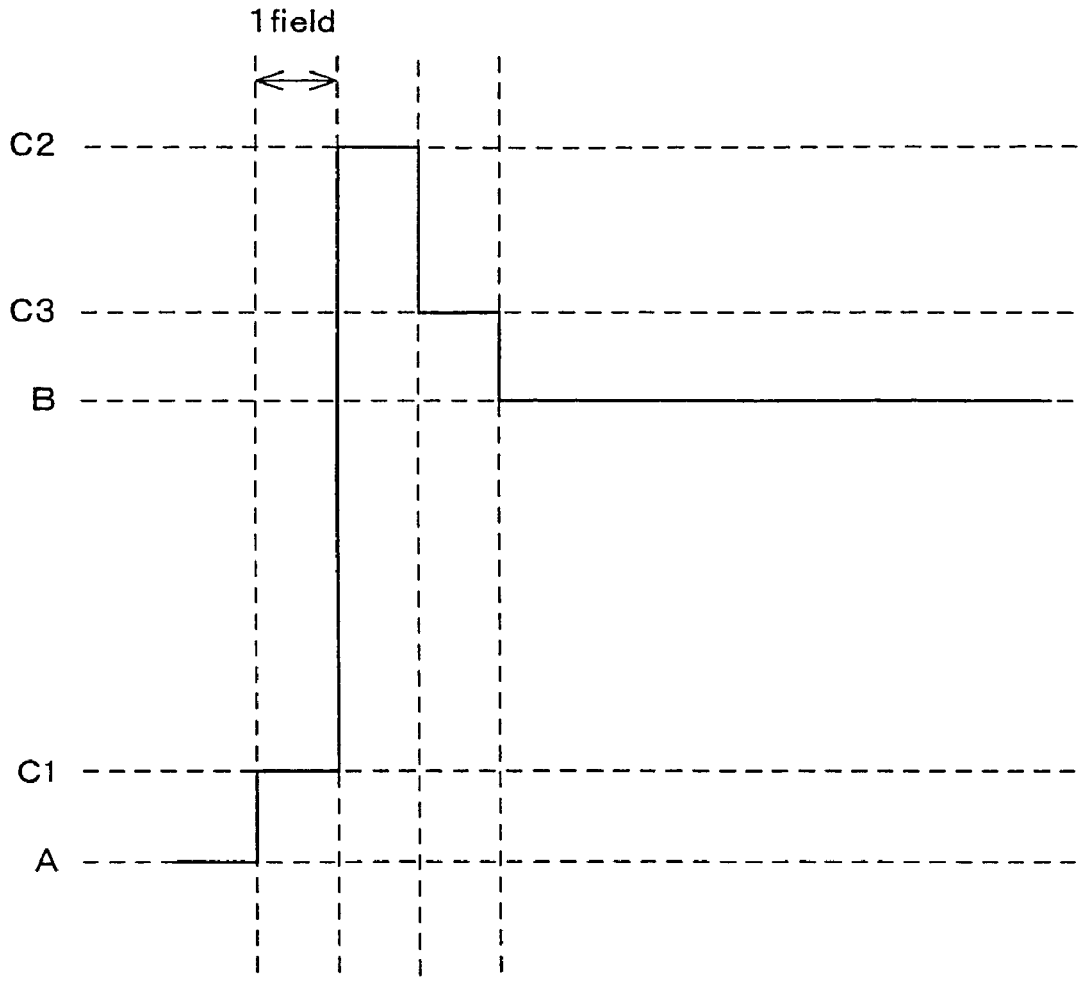
FIG. 8 is a waveform chart showing another example of a signal for switching in three-field overshoot driving.
Figure 10:
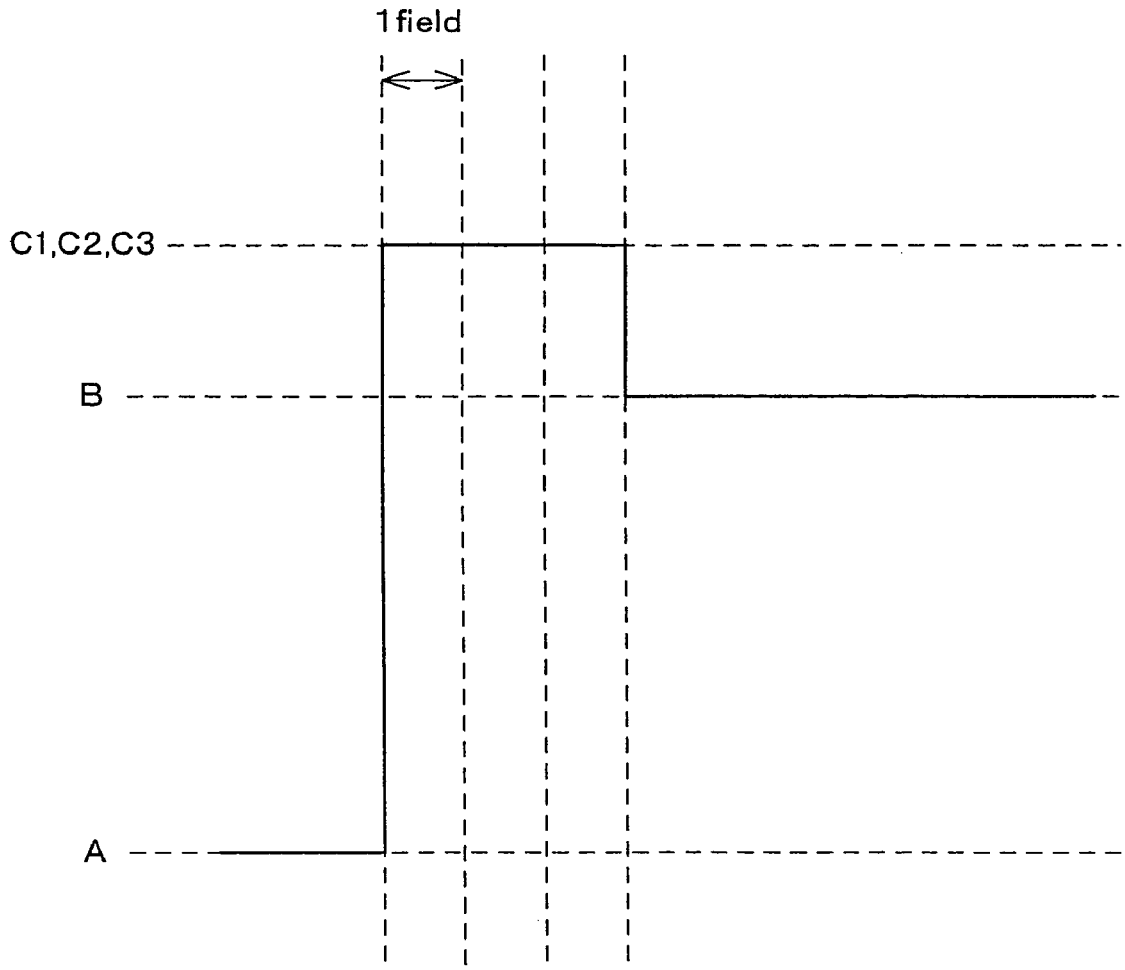
FIG. 10 is a waveform chart showing a further example of a signal for switching in three-field overshoot driving.

Here, it is assumed that OS signal levels that change with time are sequentially C1, C2, . . . , and Cn in this order. In rise response where A<B, C1 through Cn with respect to tones A and B may satisfy B≦C1≧C2≧ . . . ≧Cn as shown in FIG. 7, or A<C1≦ . . . ≦Ck<B≦Ck+1≧ . . . ≧Cn (k is an integer that satisfies 1≦k≦n) as shown in FIG. 8, or B≦C1=C2= . . . =Cn as shown in FIG. 10. Note that, FIGS. 7, 8, and 10, and the following explanation assume cases where n=3.

Likewise, in the decay response, C1 through Cn with respect to tones A and B may satisfy B≧C1≦C2≦ . . . ≦Cn corresponding to the case as shown in FIG. 7, A>C1 ≧ . . . ≧Ck>B≧Ck+1≦ . . . ≦Cn corresponding to the case as shown in FIG. 8, or B≧C1=C2= . . . =Cn corresponding to the case as shown in FIG. 10.

It is not completely desirable to simultaneously process both the one-field OS driving as shown in FIG. 12 and the multi-field OS driving as shown in FIGS. 7, 8, and 10, in terms of the circuit scale. But the multi-field OS driving is effective for tone transition where transition in the parameters C1, C2, . . . , is large in a case of the multi-field OS driving.

Figure 11:
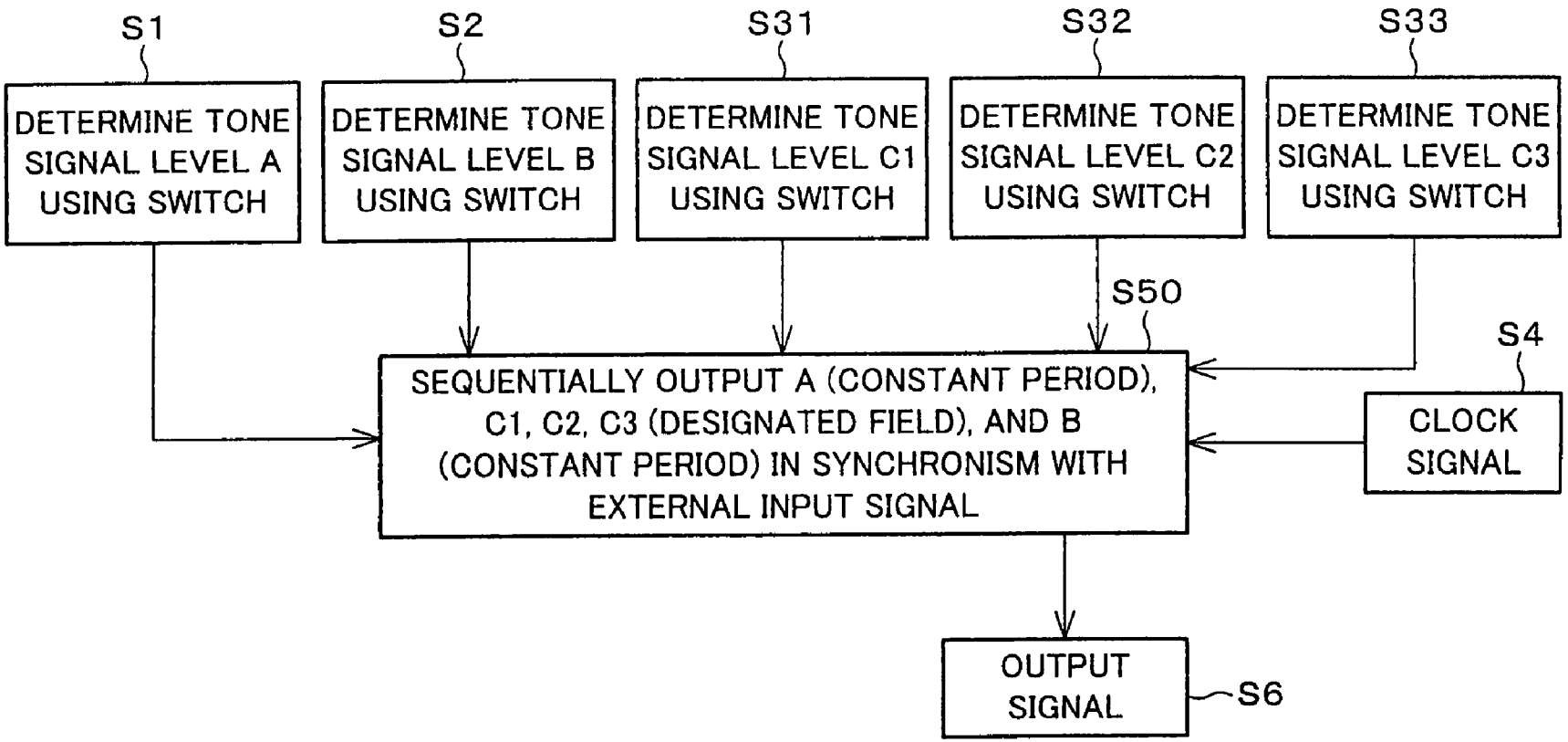
FIG. 11 is a flow chart used for explaining the operation of generating a video signal for multi-field overshoot driving.

FIG. 11 is a flow chart used for explaining the operation of generating a video signal shown in FIG. 7, 8, or 10. This operation is realized in the following manner. In the evaluation apparatus 1 shown in FIG. 1, the video signal generating circuit 3 is provided with switches for individually setting three OS signal levels C1, C2, and C3, and outputs a video signal whose level changes from A to B via C1, C2, and C3 sequentially in this order (test driving over multiple field periods). Then, the waveform analysis device 5 stores the thus obtained OS parameters (levels of the overshoot signal corresponding to the optimum output waveform with respect to each of the field periods) C1, C2, and C3. In FIG. 11, the same reference symbols are assigned to parts similar to and corresponding to those used in FIG. 3, thus their explanation is omitted here.

In the present embodiment, the signal levels A and B are set in the steps S1 and S2, and the three OS signal levels C1 through C3 are set in steps S31 through S33. In a step S50, a video signal whose level changes from A to B via C1, C2, and C3 sequentially in this order, which are the levels set by the switch systems, is outputted in response to a clock signal supplied in the step S4. In the step S6, the signal is outputted to the liquid crystal panel 2 via the signal output section 14.

As described above, the switch systems independently set the OS signal levels C1 through C3, and each of the switch systems is composed of two types of switches respectively for coarse adjustment and fine adjustment. If the total tones are 256 as described earlier, for example, the OS signal levels C1 through C3 to be switched with respect to every tone are a total of 256×n.

With the foregoing arrangement, it is possible to measure the OS signal levels C1 through C3 accurately in a short period, compared with time-consuming evaluation in which the OS signal levels C1 through C3 are changed with respect to every tone.

Table 5 shows the LUT of the OS parameter C obtained in the one-field OS driving. Here, a method to apply the multi-field OS driving to a liquid crystal panel having the LUT of Table 5 will be examined.

TABLE 5

| START | ATTAINMENT TONE | | | | | | | | |
|---|---|---|---|---|---|---|---|---|---|
| TONE | 0 | 32 | 64 | 96 | 128 | 160 | 192 | 224 | 255 |
| 0 | 0 | 204 | 228 | 242 | 251 | 255 | 255 | 255 | 255 |
| 32 | 0 | 32 | 140 | 188 | 217 | 233 | 244 | 253 | 255 |
| 64 | 0 | 7 | 64 | 145 | 191 | 219 | 236 | 249 | 255 |
| 96 | 0 | 3 | 18 | 96 | 160 | 202 | 227 | 245 | 255 |
| 128 | 0 | 0 | 9 | 55 | 128 | 183 | 218 | 241 | 255 |
| 160 | 0 | 0 | 4 | 21 | 95 | 160 | 206 | 237 | 255 |
| 192 | 0 | 0 | 1 | 11 | 59 | 136 | 192 | 231 | 255 |
| 224 | 0 | 0 | 0 | 6 | 22 | 102 | 171 | 224 | 255 |
| 255 | 0 | 0 | 0 | 0 | 8 | 33 | 130 | 207 | 255 |

First, the multi-field OS driving may be such that the initial OS signal level C1 is highest and then the OS signal level is gradually phased down, as in the cases where B≦C1≧C2≧ . . . ≧Cn in the rise response as shown in FIG. 7, and B≧C1≦C2≦ . . . ≦Cn in the decay response. The driving is effective if one-field OS driving cannot complete the response due to low temperature, etc. This driving method is preferably applied to cases corresponding to the shaded portions in the LUT of Table 5. For example, in decay response from 192nd tone to 32nd tone, 32nd tone cannot be attained with one-field OS driving. In the multi-field OS driving, 0 is given as C1 so as to allow the liquid crystal to respond to the fullest, and then a closest value for attaining 32nd tone is found as C2. When C2 is 8 (not shown), 32nd tone are attained from the tone attained as C1. In this case, the OS signal levels after C2 are 32, namely C3=B. Hence, B(32)>C1(0)<C2(8)<C3(32)= . . . = B(32) is satisfied. In rise response, the sequence of the OS signal levels is in reverse order (in transition from 0 tone to 255th or 224th tone, for example, because the response characteristic is good in rise response, and in transition from 32nd tone to 192nd tone, C2=C3= . . . = B=192 is satisfied where C1=244).

Next, as shown in FIG. 8, the multi-field OS driving may be such that the OS signal levels C1 through Ck are set to weak undershoot levels in the first through kth fields so as to slightly cause the liquid crystal to respond, and the OS signal levels Ck+1 through Cn are set to original levels (to be aimed) of the overshoot signal in the subsequent k+1th through nth fields, such as A<C1≦ . . . ≦Ck<B≦Ck+1≧ . . . ≧Cn in the rise response and A>C1≧ . . . Ck>B≧Ck+1≦ . . . ≦Cn in the decay response. This driving is effective if the liquid crystal is not easily switched as in cases corresponding to the screened portions (cross-hatched area) in the LUT of Table 5.

In the cases corresponding to data in the screened portions, the liquid crystal does not easily respond for some reason so that an abnormally high OS signal level is required in the one-field OS driving. Due to this forcible switching using the high OS signal level or some other reason, the display tone level remarkably drops when the OS signal is interrupted after the first field, and then a predetermined tone level is attained only after a while. This is because, in a liquid crystal of VA type whose data are shown in the LUT, the switching from 0 tone where liquid crystal molecules are vertically aligned entails a time lag between a point when a switching signal is applied and a point when a direction of tilting the liquid crystal molecules is determined.

Here, in transition from 0 tone to 96th tone, 32 is given as C1 first so as to slightly tilt the liquid crystal molecules, and then 200 is given as C2 so as to realize smooth transition to 96th tone. Further, as the 96th tone are attained here, the OS signal level after C2 is constantly 96, namely the OS driving is finished. This remarkably prevents such dropping of the tone level as occurred in the one-field OS driving. In other words, this rise response satisfies A(0)<C1(32)<B(96)<C2(200). In the decay response, the sequence of the OS signal levels is in reverse order.

Figure 9:
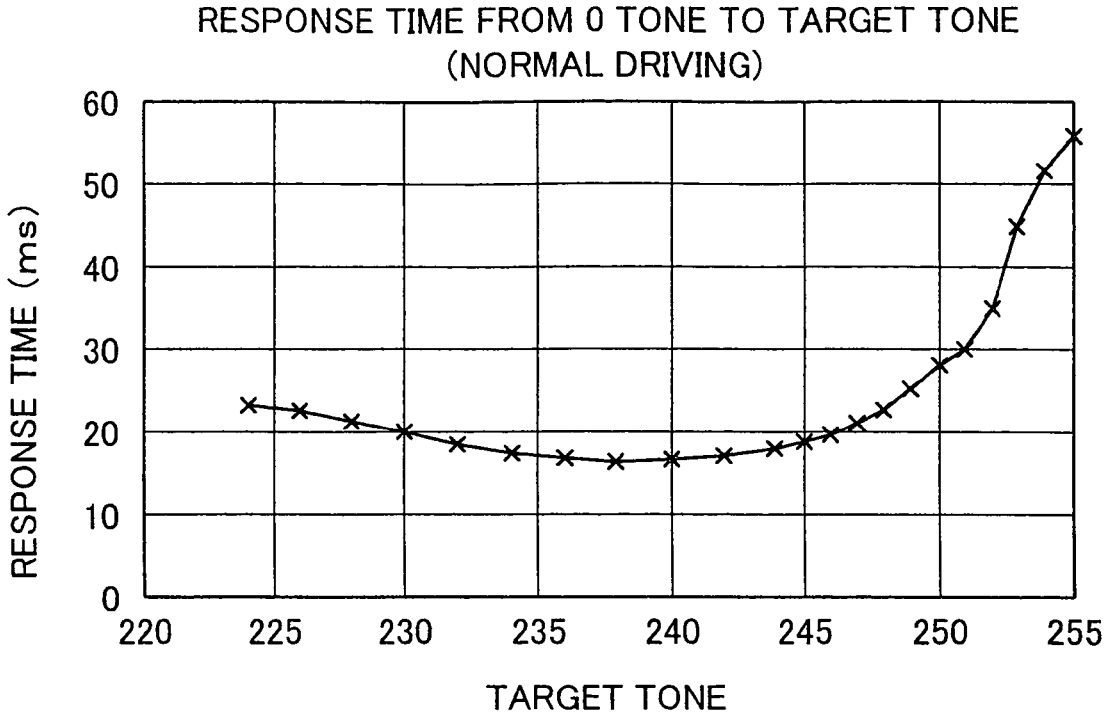
FIG. 9(*a*) is a graph showing a response time from 0 tone to target tone (in the vicinity of 255th tone) in normal driving.
Figure 9:
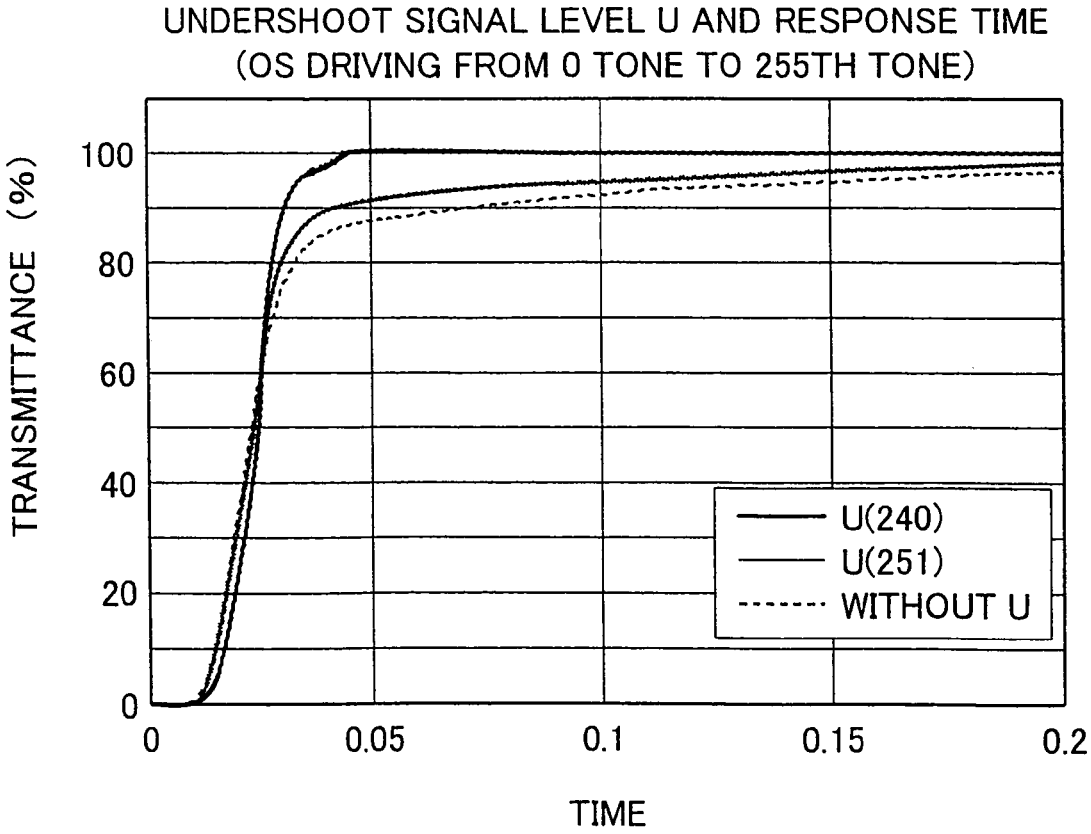

Here, FIG. 9(*a*) shows a time required for a rise response from 0 tone to a predetermined target tone (220th tone through 255th tone) in the normal driving (without the OS driving). As shown in FIG. 9(*a*), the response time from 0 tone to 255th tone is the longest, and the response time from 0 tone to 240th tone is approximately the shortest.

Then, FIG. 9(*b*) shows response times in rise response from 0 tone to 255th tone in either cases where (i) U is an undershoot signal of 240th tone, (ii) U is an undershoot signal of 251st tone, or (iii) U is not given (an undershoot signal is not given, but an overshoot signal of 255th tone is directly given), where A (0 tone as the original tone)<U<B (overshoot signal of 255th tone as the attainment tone).

As shown in FIG. 9(*b*), the response time is far longer than 50 ms when the overshoot signal of 255th tone is directly given without an undershoot signal, or when the overshoot signal of 255th tone is given after the undershoot signal of 251st tone is given. In contrast, the response time is shorter than 50 ms when the overshoot signal of 255th tone is given after the undershoot signal of 240th tone is given.

When A is the original tone and B is the attainment tone as described above, the following evaluation is also effective. Namely, normal driving (without the OS driving) is performed using the original tone A and a parameter tone Up as an attainment tone which is smaller than the attainment tone B. Then, a tone Umin that approximately minimizes the response time is found and set to an undershoot signal level (240th tone in FIG. 9(*a*)) (in other words, in transition where A is the original tone and B is the attainment tone, a signal corresponding to the original tone A, an undershoot signal corresponding to the tone Umin, and a signal corresponding to the attainment tone B are sequentially supplied to the liquid crystal panel 2).

Next, as shown in FIG. 10, the driving may be such that the OS signal levels are constantly the same, as in the cases where B≦C1=C2= . . . =Cn in the rise response and B≧C1=C2= . . . =Cn in the decay response. This driving is effectively applied to any driving including the driving as shown in FIGS. 7 and 8. Namely, the measurement becomes easier because the parameters can be set to be the same rather than the parameters are set differently from one another.

As described above, in rise response where A<B, OS signal levels C1 through Cn with respect to the tones A and B satisfy B≦C1≧C2≧ . . . ≧Cn; a kth OS signal level Ck (k is an integer that satisfies 1≦k≦n) is set to a maximum value that does not cause a response waveform with respect to the OS signal level Ck to exceed a level of the attainment tone B; and if the response waveform with respect to the OS signal level Ck substantially reaches the level of the attainment tone B, Ck+1 through Cn are set to B. On the other hand, in decay response where A>B, OS signal levels C1 through Cn satisfy B≧C1≦C2≦ . . . ≦Cn; a kth OS signal level Ck (k is an integer that satisfies 1≦k≦n) is set to a minimum value that does not cause a response waveform with respect to the OS signal level Ck to exceed a level of the attainment tone B; and if the response waveform with respect to the OS signal level Ck substantially reaches the level of the attainment tone B, Ck+1 through Cn are set to B. This realizes multi-field OS driving in which the initial OS signal level C1 is highest, and then the OS signal level becomes gradually lower. This is effective in cases where the response is not complete in the one-field OS driving due to low temperature, etc.

Further, in rise response where A<B, OS signal levels C1 through Cn with respect to the tones A and B satisfy A≦C1≦ . . . ≦Ck<B≦Ck+1≧ . . . ≧Cn; a jth OS signal level Cj (j is an integer that satisfies k+1≦j≦n) is set to a maximum value that does not cause a response waveform with respect to the OS signal level Cj to exceed a level of the attainment tone B; and if the response waveform with respect to the OS signal level Cj substantially reaches the level of the attainment tone B, Cj+1 through Cn are set to B. Further, in decay response where A>B, OS signal levels C1 through Cn satisfy A>C1≧ . . . ≧Ck>B≧Ck+1≦ . . . ≦Cn; a jth OS signal level Cj (j is an integer that satisfies k+1≦j≦n) is set to a minimum value that does not cause a response waveform with respect to the OS signal level Cj to exceed a level of the attainment tone B; and if the response waveform with respect to the OS signal level Cj substantially reaches the level of the attainment tone B, Cj+1 through Cn are set to B. This realizes multi-field OS driving in which the OS signal levels C1 through Ck are set to weak undershoot levels in the first through kth fields so as to slightly cause the liquid crystal to respond, and the OS signal levels Ck+1 through Cn are set to original levels (to be aimed) of the overshoot signal in the subsequent k+1th through nth fields, as shown in FIG. 8. This is effective in portions where the liquid crystal is not easily switched.

Further, in rise response where A<B, OS signal levels C1 through Cn with respect to the tones A and B satisfy B≦C1=C2= . . . =Cn; and a kth OS signal level Ck (k is an integer that satisfies 1≦k≦n) is set to a maximum value that does not cause a response waveform with respect to the OS signal levels C1 through Cn to exceed a level of the attainment tone B. On the other hand, in decay response where A>B, OS signal levels C1 through Cn satisfy B≧C1=C2= . . . =Cn; and a kth OS signal level Ck (k is an integer that satisfies 1≦k≦n) is set to a maximum value that does not cause a response waveform with respect to the OS signal levels C1 through Cn to exceed a level of the attainment tone B. This can realize multi-field OS driving in which all parameters are set equal, as shown in FIG. 10.

Further, by mounting the thus obtained LUT into the controller of the liquid crystal panel 2, it is possible to realize a liquid crystal display device which can respond at high speed without deteriorating video images.

Further, with the evaluation method in the present invention, the response waveforms are analyzed while varying the levels C1, C2, . . . , and Cn of the overshoot signal over n field periods with respect to the tone before being changed A and the tone to be attained B. Then, among the response waveforms with respect to combination of C1, C2, . . . , and Cn, a response waveform that reaches the attainment tone B fastest without overresponse is stored in association with the tone before being changed A and the attainment tone B. An overshoot drive circuit which has the combination of C1, C2, . . . , Cn (optimum OS parameters C1 through Cn) as an LUT can apply an optimum signal that has a necessary and sufficient response characteristic to the liquid crystal panel. Namely, a liquid crystal display device (liquid crystal display) having the overshoot drive circuit can achieve an excellent response characteristic and display quality without deteriorating video images.

Note that, the foregoing explained the case where the attainment tone B is supplied, but the attainment tone B having a function of braking the OS driving is not necessarily supplied. This is because C gets equal to B and the attainment tone B may not be attained even at the end of the OS driving period, in particular, when the tone change is large. In this case, the optimum OS signal level can be determined without being supplied with the attainment tone B. When the tone change is easily performed, the optimum OS signal level can be measured highly accurately by supplying the attainment tone B having the function of braking the OS driving. Moreover, it is effective to supply the attainment tone B so as to improve the accuracy, particularly because the influence of noise is large if the tone change is between low tones or if the tone change is performed under low temperature conditions.

Further, the present invention has an objective to perform measurement using the OS driving. It is also possible to manufacture a liquid crystal evaluation apparatus capable of performing both the conventional evaluation and the evaluation using the OS driving by incorporating the evaluation apparatus 1 of the present invention into a conventional evaluation apparatus of a liquid crystal panel. For example, the evaluation apparatus 1 of the present invention can be combined with a device for measuring voltage-brightness characteristics.

The present invention is not limited to the foregoing embodiments, but may be widely used for determining the OS driving level of the liquid crystal panel.

As described above, the evaluation apparatus of a liquid crystal display device of the present invention is preferably arranged so as to include an optical light-receiving element provided in the display detection section; and a waveform analysis device provided in the analysis section so as to receive an output from the optical light-receiving element, the waveform analysis device analyzing waveforms of the output of the optical light-receiving element supplied in response to the test driving so as to obtain (i) relationship between a maximum or minimum level in each of the waveforms and a level corresponding to the attainment tone, and (ii) a time required for attaining the level corresponding to the attainment tone, and storing in association with the original tone and the attainment tone, a level of the overshoot signal that corresponds to an optimum one of the waveforms.

With this arrangement, the liquid crystal panel to be evaluated shows a display state corresponding to each overshoot signal (level), and the optical light-receiving element senses the display state and supplies a detection result (output) to the waveform analysis device. The waveform analysis device then analyzes waveforms of the output of the optical light-receiving element supplied in accordance with the overshoot signal, so as to obtain (i) relationship between a maximum or minimum level in each of the waveforms and a level corresponding to the attainment tone, and (ii) a time required for attaining the level corresponding to the attainment tone, thereby finding out an optimum one of the waveforms.

For example, in rise response where the tone A<the tone B, one of the waveforms which has the maximum level not higher than the level corresponding to the attainment tone and which reaches the level of the attainment tone fastest may be set to the optimum waveform, and a level of the overshoot signal corresponding to the optimum waveform may be set to the optimum level of the overshoot signal. Likewise, in decay response where the tone A>the tone B, one of the waveforms which has the minimum level not lower than the level corresponding to the attainment tone and which reaches the level of the attainment tone fastest may be set to the optimum waveform, and a level of the overshoot signal corresponding to the optimum waveform may be set to the optimum level of the overshoot signal. With this arrangement, it is possible to find out an optimum overshoot signal (level) more easily as described above.

The evaluation apparatus of a liquid crystal display device is preferably arranged so as to include a thermostatic chamber which contains the liquid crystal panel.

Further, the evaluation apparatus of a liquid crystal display device is preferably arranged so that the signal section includes switches which respectively correspond to (i) the signal corresponding to the original tone, (ii) the overshoot signal, and (iii) the signal corresponding to the attainment tone, each of the switches being digitally controlled so as to output as one of the signals (i), (ii), and (iii) a voltage according to how the each of the switches is turned ON or OFF.

Further, the evaluation apparatus of a liquid crystal display device is preferably arranged so that the level of the overshoot signal that the signal section supplies to the liquid crystal panel sequentially changes in accordance with tone transition from the original tone to the attainment tone; and the analysis section sequentially stores in association with the original tone and the attainment tone, a level of the overshoot signal that corresponds to an optimum one of the detection results.

Further, the evaluation apparatus of a liquid crystal display device is preferably arranged so that the level of the overshoot signal that the signal section supplies to the liquid crystal panel is sequentially phased down in predetermined tone transition where the original tone is smaller than the attainment tone.

Further, the evaluation apparatus of a liquid crystal display device is preferably arranged so that the level of the overshoot signal that the signal section supplies to the liquid crystal panel is sequentially phased up in predetermined tone transition where the original tone is larger than the attainment tone.

Further, the evaluation apparatus of a liquid crystal display device is preferably arranged so that the level of the overshoot signal that the signal section supplies to the liquid crystal panel is unchanged during one field period.

The evaluation apparatus of a liquid crystal display device is preferably arranged so that the signal section supplies to the liquid crystal panel an undershoot signal in accordance with tone transition from the original tone to the attainment tone, after supplying the signal corresponding to the original tone and before supplying the overshoot signal, and performs the test driving while sweeping levels of the overshoot signal and the undershoot signal; and the analysis section stores in association with the original tone and the attainment tone, levels of the overshoot signal and the undershoot signal that correspond to an optimum one of the detection results.

Further, the evaluation apparatus of a liquid crystal display device is preferably arranged so that the level of the undershoot signal that the signal section supplies to the liquid crystal panel sequentially changes in predetermined tone transition; and the analysis section sequentially stores in association with the original tone and the attainment tone, a level of the undershoot signal that corresponds to an optimum one of the detection results.

Further, the evaluation apparatus of a liquid crystal display device is preferably arranged so that the level of the undershoot signal that the signal section supplies to the liquid crystal panel is sequentially phased up in predetermined tone transition where the original tone is smaller than the attainment tone.

Further, the evaluation apparatus of a liquid crystal display device is preferably arranged so that the level of the undershoot signal that the signal section supplies to the liquid crystal panel is sequentially phased down in predetermined tone transition where the original tone is larger than the attainment tone.

Further, the evaluation apparatus of a liquid crystal display device is preferably arranged so that the level of the undershoot signal that the signal section supplies to the liquid crystal panel is unchanged during one field period.

As described above, the evaluation apparatus of a liquid crystal display device may be arranged so as to include a video signal generating circuit provided in the signal section; an optical light-receiving element provided in the display detection section; and a waveform analysis device provided in the analysis section so as to receive an output from the optical light-receiving element, the video signal generating circuit sequentially supplying to the liquid crystal panel (i) the signal corresponding to the original tone, (ii) the overshoot signal with respect to each of a plurality of field periods, and (iii) the signal corresponding to the attainment tone in this order so as to perform the test driving over the plurality of field periods, while sweeping the level of the overshoot signal in each of the plurality of field periods, the waveform analysis device analyzing output waveforms of the optical light-receiving element supplied in response to the test driving over the plurality of field periods so as to obtain (i) relationship between a maximum or minimum level in each of the plurality of field periods and a level corresponding to the attainment tone, and (ii) a time required for attaining the level corresponding to the attainment tone, and storing in association with the original tone and the attainment tone, a level of the overshoot signal that corresponds to an optimum one of the waveforms with respect to each of the field periods.

First, the OS driving in which a plurality of levels of the overshoot signal is supplied over a plurality of field periods is effective for tone change (combination of tone A and tone B) where overshoot driving is not properly performed by supplying only one level of the overshoot signal in one field period, for example.

With this arrangement, the video signal generating circuit sequentially supplies to the liquid crystal panel (i) the signal corresponding to the original tone (A), (ii) the overshoot signal with respect to each of the plurality of field periods, and (iii) the signal corresponding to the attainment tone (B) in this order so as to perform the test driving (test OS driving) over the plurality of field periods, while varying (sweeping) the levels of the overshoot signal in each of the plurality of field periods (while varying the combination of the levels of the overshoot signal with respect to each of the field periods).

With this arrangement, it is possible to supply to the liquid crystal panel different levels of the overshoot signal over a plurality of field periods. With this, it is possible to easily obtain an optimum combination of the levels of the overshoot signal that can perform proper OS driving even if proper OS driving cannot be performed by supplying only one level of the overshoot signal in one field period as described above.

Further, an evaluation apparatus of a liquid crystal display device of the present invention is arranged so as to include a video signal generating circuit for supplying a signal to a liquid crystal panel to be evaluated; an optical light-receiving element for sensing a display state of the liquid crystal panel; and a waveform analysis device to which an output is supplied from the optical light-receiving element, the video signal generating circuit sequentially supplying to the liquid crystal panel (i) a signal corresponding to an original tone and (ii) an overshoot signal in test driving, while sweeping a level of the overshoot signal, the waveform analysis device analyzing waveforms of the output of the optical light-receiving element supplied in response to the test driving so as to obtain (i) relationship between a maximum or minimum level in each of the waveforms and a level corresponding to a desired attainment tone, and (ii) a time required for substantially attaining the level corresponding to the desired attainment tone, and storing in association with the original tone and the attainment tone, a level of the overshoot signal that corresponds to an optimum one of the waveforms in accordance with analysis results.

As in this arrangement, the signal corresponding to the attainment tone that is supplied last may not be supplied in the test driving (test OS driving). Here, the output of the optical light-receiving element supplied in response to the test driving is analyzed so as to obtain a time required for substantially attaining the level corresponding to the desired attainment tone. Then, an optimum level of the overshoot signal is stored in accordance with analysis results.

With this arrangement, it is possible to easily obtain an optimum level of the overshoot signal particularly with respect to tone change where the level corresponding to the attainment tone is not easily attained completely.

A liquid crystal device of the present invention which includes a liquid crystal panel and an overshoot drive. circuit is so arranged that the overshoot drive circuit stores an optimum level of an overshoot signal as a Look-up Table; and the optimum level of the overshoot signal is obtained by an evaluation method that has the steps of repeatedly supplying to the liquid crystal panel, (i) a signal corresponding to an original tone, (ii) an overshoot signal, and (iii) a signal corresponding to an attainment tone sequentially in this order while sweeping a level of the overshoot signal; and in accordance with analysis results, determining the optimum level of the overshoot signal in association with the original tone and the attainment tone.

An overshoot drive circuit which has the optimum overshoot signal (level) that is obtained by the above evaluation method as a Look-up Table (LUT) can apply an optimum signal (overshoot signal) that has a necessary and sufficient response characteristic to the liquid crystal panel. Namely, a liquid crystal display device having the overshoot drive circuit can achieve an excellent response characteristic and display quality without deteriorating video images.

An evaluation apparatus of a liquid crystal display device of the present invention is arranged so as to include a signal section for supplying a signal to a liquid crystal panel to be evaluated; a display detection section for sensing a display state of the liquid crystal panel; and an analysis section for analyzing a detection result of the display detection section, the signal section sequentially supplying to the liquid crystal panel a signal corresponding to an original tone and then, in accordance with tone transition from the original tone to an attainment tone, either (i) an overshoot test signal or (ii) both an overshoot test signal and an undershoot test signal in test driving, while sweeping either a level of the signal (i) or levels of both the signals (ii), the analysis section analyzing detection results of the display detection section obtained in the test driving and storing in association with the original tone and the attainment tone, either a level of the signal (i) or levels of both the signals (ii) that corresponds to an optimum one of the detection results in accordance with analysis results.

First, the undershoot test signal is either a signal whose level is lower than the level of the signal corresponding to the attainment tone (B) (in rise response where the original tone A<the attainment tone B), or a signal whose level is higher than the signal corresponding to the attainment tone (B) (in decay response where the original tone A>the attainment tone B).

With this arrangement, the signal section performs test driving on the liquid crystal panel in the following manner. Namely, the signal section sequentially supplies to the liquid crystal panel a signal corresponding to the original tone (A) and then, in accordance with tone transition from the original tone to the attainment tone, either (i) an overshoot test signal or (ii) both an overshoot test signal and an undershoot test signal, while varying (sweeping) a level of the overshoot test signal and a level of the undershoot test signal.

As a result, the liquid crystal panel to be evaluated shows a display state corresponding to each overshoot signal (level), and the display detection section senses the display state. The analysis section then analyzes detection results so as to find out an optimum one of the detection results in a case where the original tone is A and the attainment tone is B, and either a level of the signal (i) or levels of both the signals (ii) corresponding to the optimum one of the detection results is stored in association with the original tone A and the attainment tone B.

Further, the evaluation apparatus of a liquid crystal display device of the present invention is preferably arranged so that the overshoot test signal that the signal section supplies to the liquid crystal panel has a plurality of levels in predetermined tone transition; and the analysis section stores in association with the original tone and the attainment tone, a combination of the plurality of levels in the overshoot test signal that corresponds to an optimum one of the detection results.

Further, the evaluation apparatus of a liquid crystal display device of the present invention is preferably arranged so that the signal section sequentially supplies to the liquid crystal panel (i) the signal corresponding to the original tone, (ii) the undershoot test signal which has at least one level, and (iii) the overshoot test signal which has at least one level in this order in predetermined tone transition; and the analysis section stores in association with the original tone and the attainment tone, levels of the undershoot test signal and the overshoot test signal that correspond to an optimum one of the detection results.

Further, the evaluation apparatus of a liquid crystal display device of the present invention may be arranged so that the level of the test signal that the signal section supplies to the liquid crystal panel is unchanged during one field period.

Further, the evaluation apparatus of a liquid crystal display device of the present invention is preferably arranged so that an optical light-receiving element provided in the display detection section; and a waveform analysis device provided in the analysis section so as to receive an output waveform from the optical light-receiving element, the waveform analysis device analyzing output waveforms of the optical light-receiving element supplied in response to the test driving so as to obtain (i) relationship between a maximum or minimum level in each of the output waveforms and a level corresponding to the attainment tone, and (ii) a time required for attaining the level corresponding to the attainment tone, and storing in association with the original tone and the attainment tone, a level of the test signal that corresponds to an optimum one of the output waveforms in accordance with analysis results.

Further, an evaluation method of a liquid crystal display device is arranged so as to include the steps of repeatedly supplying to a liquid crystal panel to be evaluated, a signal corresponding to an original tone and then, in accordance with tone transition from the original tone to an attainment tone, either (i) an overshoot test signal or (ii) both an overshoot test signal and an undershoot test signal while sweeping either a level of the signal (i) or levels of both the signals (ii), so as to analyze display results of the liquid crystal panel; and storing in association with the original tone and the attainment tone, either a level of the signal (i) or levels of both the signals (ii) that corresponds to an optimum one of analysis results.

Further, a liquid crystal display device of the present invention which includes a liquid crystal panel and a drive circuit is arranged so that the drive circuit stores as a Look-up Table an optimum level of either (i) an overshoot test signal or (ii) both an overshoot test signal and an undershoot test signal in accordance with tone transition from an original tone to an attainment tone; and the optimum level is set to a level of the test signal that corresponds to an optimum one of display results, which is obtained by repeatedly supplying to the liquid crystal panel, a signal corresponding to the original tone and then, in accordance with the tone transition, either (i) the overshoot test signal or (ii) both the overshoot test signal and the undershoot test signal while sweeping a level of the test signal, so as to analyze the display results of the liquid crystal panel.

Further, the liquid crystal display device of the present invention is preferably arranged so that the drive circuit stores as a Look-up Table an optimum combination of a plurality of levels of the overshoot signal in predetermined tone transition; and the optimum combination is set to a combination of levels of the overshoot test signal that corresponds to an optimum one of display results, which is obtained by repeatedly supplying to the liquid crystal panel, a signal corresponding to the original tone and then the overshoot test signal having a plurality of levels while sweeping the levels of the overshoot test signal, so as to analyze the display results of the liquid crystal panel.

Further, the liquid crystal display device of the present invention is preferably arranged so that the drive circuit stores as a Look-up Table an optimum combination of a level of the overshoot signal and a level of an undershoot signal in predetermined tone transition; and the optimum combination is set to a combination of a level of the undershoot test signal and a level of the overshoot test signal that corresponds to an optimum one of display results, which is obtained by repeatedly supplying to the liquid crystal panel, a signal corresponding to the original tone, the undershoot test signal, and the overshoot test signal sequentially in this order while sweeping the levels of the undershoot and overshoot test signals, so as to analyze the display results of the liquid crystal panel.

Further, the liquid crystal display device of the present invention is preferably arranged so that the optimum one of display results is a display result where the attainment tone is substantially displayed fastest without exceeding the attainment tone.

Further, the liquid crystal display device of the present invention is preferably arranged so that the Look-up Table is stored with respect to each of a plurality of temperatures.

With this arrangement, the LUT is optimally referred in accordance with a temperature sensed by a temperature sensor which is provided to the liquid crystal panel, for example. With this, it is possible to achieve high display quality on the liquid crystal display device without affected by an ambient temperature at which the liquid crystal display device is driven.

As described above, an evaluation apparatus of a liquid crystal display device of the present invention is arranged so as to include a video signal generating-circuit for supplying a video signal to a liquid crystal panel to be evaluated; an optical light-receiving element facing a display section of the liquid crystal panel; and a waveform analysis device to which an output is supplied from the optical light-receiving element, the video signal generating circuit supplying to the liquid crystal panel a video signal whose level changes from A to C, then from C to B, where A is a tone before being changed, B is a tone to be attained, and C is a level of an overshoot signal (including a case where C=B), while sweeping the level of the overshoot signal C; and the waveform analysis device stores in association with the tone before being changed A and the attainment tone B, a level of the overshoot signal C that realizes a response waveform which reaches the attainment tone B fastest without overresponse, among response waveforms obtained while sweeping the level of the overshoot signal C.

With this arrangement, the response characteristic of liquid crystal is evaluated to determine the optimum overshoot parameter (actual level of the overshoot signal) in order to perform the overshoot driving for improving the response characteristic of liquid crystal. For achieving this, first, provided is the video signal generating circuit which can output to the liquid crystal panel a video signal whose level changes from A to C, then from C to B, where A is a tone before being changed, B is a tone to be attained, and C is a level of an overshoot signal, while sweeping the level of the overshoot signal C.

Next, display images on the liquid crystal panel in accordance with the video signal is subjected to photo-electric conversion by the optical light-receiving element, so as to be picked up by the waveform analysis device. Then, as the optimum overshoot parameter, the waveform analysis device stores in association with the tone before being changed A and the attainment tone B, a level of the overshoot signal C that realizes a response waveform which reaches the attainment tone B fastest without overresponse, among display results with respect to the variously swept levels of the overshoot signal C.

Specifically, in rise response, for example, the level C with respect to tones A and B that satisfy A<B is not less than the level of the attainment tone B. Here, the overshoot parameter can be correctly determined by observing the response waveform while changing the level C so as to find the maximum level C that does not cause the response waveform to exceed the level B. Namely, by using the thus obtained level C for overshoot driving, it is possible to attain a display tone having a level closest to the desired attainment tone B within an overshoot driving period without deteriorating video images. Further, in decay response, the level C with respect to tones A and B that satisfy A>B is not more than the level of the attainment tone B. Here, the overshoot parameter can be correctly determined by observing the response waveform while changing the level C so as to find the minimum level C that does not cause the response waveform to exceed the level B.

Further, a Look-up Table (LUT) of the optimum overshoot parameter in association with the tone before being changed A and the attainment tone B may be set in the drive circuit for overshoot driving of the liquid crystal panel. With this, the drive circuit can refer to the LUT in response to the tone before being changed A and attainment tone B of an inputted video signal so as to determine the optimum overshoot parameter, thereby properly performing overshoot driving on the liquid crystal panel.

In this manner, the present invention can obtain the optimum overshoot parameter with ease and high accuracy. Further, a liquid crystal panel without the function of overshoot driving can be also measured using the overshoot signal. If the overshoot driving is newly introduced to the liquid crystal panel later, two operations, namely circuit designing and the determination of the overshoot parameter, are generally required. In contrast, the present invention can obtain the parameter for the overshoot driving even if the circuit has not been complete yet, namely even if the overshoot driving cannot be performed.

The evaluation apparatus of a liquid crystal display device of the present invention is so arranged that overshoot driving is performed over n field periods (n is an integer not less than 1); the level of the video signal that the video signal generating circuit supplies to the liquid crystal panel sequentially changes from A to C1 through Cn, then from C1 through Cn to B over the n field periods while levels of the overshoot signal C1 through Cn are being swept, where the levels of the overshoot signal over the n field periods are sequentially C1, C2, . . . , and Cn in this order; and the waveform analysis device stores in association with the tone before being changed A and the attainment tone B, levels of the overshoot signals C1 through Cn that realize a response waveform which reaches the attainment tone B fastest without overresponse, among response waveforms obtained while sweeping the levels of the overshoot signal C1 through Cn.

With this arrangement, the level of the overshoot signal while being applied needs not to be constant. The overshoot driving may be performed over multiple field periods if the response speed of liquid crystal is remarkably low under low temperature, in double speed driving, and the like. The overshoot driving can have a broader range of applications by applying different levels of the overshoot signal with respect to each of the field periods. The video signal generating circuit thus outputs the levels of the overshoot signal C1, C2, . . . , and Cn (n is an integer not less than 1) sequentially in this order respectively for predetermined periods. Namely, the video signal generating circuit outputs a signal having (n+2) types of levels, including the tone before being changed A and the attainment tone B.

By generating various levels of n field (multi-field) overshoot driving signal, it is possible to accurately and easily determine the overshoot parameter corresponding to the overshoot driving over the multiple fields.

The evaluation apparatus of a liquid crystal display device of the present invention is arranged so as to further include a thermostatic chamber which contains at least the liquid crystal panel.

With this arrangement, the thermostatic chamber is provided. The thermostatic chamber may contain the optical light-receiving element together with the liquid crystal panel. Alternatively, the thermostatic chamber may contain only the liquid crystal panel, and is provided with a window through which the display section of the liquid crystal panel can be observed from the outside. With this, the display results can be observed by providing the optical light-receiving element at the window, for example.

With this, the liquid crystal panel can be evaluated under a constant temperature. Further, the liquid crystal panel can be evaluated under various environment temperatures so that the optimum overshoot parameter can be obtained with respect to each of the temperatures. Further, by providing the window to the thermostatic chamber, the measurer can promptly find the defect during the evaluation, thereby easily taking measures against the defect.

The evaluation apparatus of a liquid crystal display device of the present invention is arranged so that the video signal generating circuit includes switches which respectively correspond to the signal corresponding to the tone before being changed A, the tone to be attained B, and the level of the overshoot signal C, each of the switches being digitally controlled so as to output as the video signal a voltage according to how the each of the switches is turned ON or OFF.

With this arrangement, it is possible to digitally adjust the tone before being changed A, the attainment tone B, and the level of the overshoot signal C variously and independently by turning ON/OFF the switches. Each of the switches is preferably a multi-bit switch. With this, the overshoot parameter can be set in detail with respect to switching between any tones.

Further, the evaluation apparatus of a liquid crystal display device of the present invention is arranged so that the switch for adjusting the level of the overshoot signal C includes two types of switches respectively for coarse adjustment and fine adjustment.

With this arrangement, the level of the overshoot signal C is roughly estimated using the switch for coarse adjustment, and then the level of the overshoot signal C is precisely determined using the switch for fine adjustment. For example, with the 256 levels of the overshoot signal C, measurement consumes time if the levels are changed with respect to every tone. Therefore the switches respectively for coarse adjustment and fine adjustment may be provided so as to roughly determine the overshoot parameter using the switch for coarse adjustment, and then precisely obtain the overshoot parameter using the switch for fine adjustment. With this, it is possible to carry out the evaluation accurately in a short period.

The evaluation apparatus of a liquid crystal display device of the present invention is arranged so that the video signal generating circuit includes switches which respectively correspond to the signal corresponding to the tone before being changed A, the attainment tone B, and the levels of the overshoot signal C1 through Cn, each of the switches being digitally controlled so as to output as the video signal a voltage according to how the each of the switches is turned ON or OFF.

With this arrangement, it is possible to digitally adjust the tone before being changed A, the attainment tone B, and the levels of the n field (multi-field) overshoot signal C1 through Cn variously and independently by turning ON/OFF the switches. Each of the switches is preferably a multi-bit switch. With this, the levels of the overshoot signal C1 through Cn can be set in detail with respect to switching between any tones.

For example, with a total of 256 tones, the tone level before being changed A and the attainment tone B are preferably switched with respect to at least every sixteen tones, and more preferably with respect to every tone. On the other hand, the levels of the overshoot signal C1 through Cn should be switched every tone because a change of one tone varies the OS effect.

By allowing the tone level before being changed A, the attainment tone B, and the levels of the overshoot signal C1 through Cn to be respectively adjusted by independent switches, it is possible to set the required level of the overshoot signal C simply and precisely without increasing the switches for the tones A and B.

The evaluation apparatus of a liquid crystal display device of the present invention is arranged so that the switch for adjusting the levels of the overshoot signal C1 through Cn includes two types of switches respectively for coarse adjustment and fine adjustment.

With this arrangement, if the total tones are 256, for example, the tone level before being changed A and the attainment tone B are switched with respect to at least every sixteen tones, and more preferably with respect to every tone. On the other hand, the levels of the overshoot signal C1 through Cn should be switched with respect to every tone. Namely, since the levels of the overshoot signal C1 through Cn to be switched with respect to every tone are a total of 256×n, measurement consumes time if the levels are changed with respect to every tone. Therefore, with respect to each of the levels of the overshoot signal C1 through Cn, the levels of the overshoot signal C1 through Cn are roughly estimated using the switch for coarse adjustment, and then the levels of the overshoot signal C1 through Cn are precisely determined using the switch for fine adjustment. With this, it is possible to carry out the evaluation accurately in a short period.

Further, the evaluation apparatus of a liquid crystal display device of the present invention is arranged so that, in rise response where A<B, C1 through Cn with respect to the tones A and B are set to satisfy $B \leqq C1 \geqq C2 \geqq \ldots \geqq Cn$; a kth level of the overshoot signal Ck (k is an integer that satisfies $1 \leqq k \leqq n$) is set to a maximum value that does not cause a response waveform with respect to the level of the overshoot signal Ck to exceed a level of the attainment tone B; and if the response waveform with respect to the level of the overshoot signal Ck substantially reaches the level of the attainment tone B, Ck+1 through Cn are set to B.

With this arrangement, in rise response, the levels of the overshoot signal C1 through Cn in all of the fields are not less than the level of the attainment tone B. Here, the optimum overshoot parameter with respect to each of the fields can be determined by observing the response waveform while changing the levels of the overshoot signal C1 through Cn sequentially from the first field so as to find the maximum level that does not cause the response waveform to exceed the level of the attainment tone B.

Then, when the response waveform reaches the level of the attainment tone B in a kth field, the overshoot driving is no longer required. Thus, the overshoot parameter can be determined with respect to all of the fields by setting Ck+1 through Cn to B.

Further, the evaluation apparatus of a liquid crystal display device of the present invention is arranged so that, in decay response where A>B, C1 through Cn with respect to the tones A and B are set to satisfy $B \geqq C1 \leqq C2 \leqq \ldots \leqq Cn$; a kth level of the overshoot signal Ck (k is an integer that satisfies $1 \leqq k \leqq n$) is set to a minimum value that does not cause a response waveform with respect to the level of the overshoot signal Ck to exceed a level of the attainment tone B; and if the response waveform with respect to the level of the overshoot signal Ck substantially reaches the level of the attainment tone B, Ck+1 through Cn are set to B.

With this arrangement, in decay response, the levels of the overshoot signal C1 through Cn in all of the fields are not more than the level of the attainment tone B. Here, the optimum overshoot parameter with respect to each of the fields can be determined by observing the response waveform while changing the levels of the overshoot signal C1 through Cn sequentially from the first field so as to find the minimum level that does not cause the response waveform to exceed the level of the attainment tone B.

Then, when the response waveform reaches the level of the attainment tone B in a kth field, the overshoot driving is no longer required. Thus, the overshoot parameter can be determined with respect to all of the fields by setting Ck+1 through Cn to B.

Further, the evaluation apparatus of a liquid crystal display device of the present invention is arranged so that, in rise response where A<B, C1 through Cn with respect to the tones A and B are set to satisfy $A \leqq C1 \leqq \ldots \leqq Ck < B \leqq Ck+1 \geqq \ldots \geqq Cn$ (k is an integer that satisfies $1 \leqq k \leqq n$); a jth level of the overshoot signal C (j is an integer that satisfies $k+1 \leqq j \leqq n$) is set to a maximum value that does not cause a response waveform with respect to the level of the overshoot signal Cj to exceed a level of the attainment tone B; and if the response waveform with respect to the level of the overshoot signal Cj substantially reaches the level of the attainment tone B, Cj+1 through Cn are set to B.

Depending on the display mode and switching tone, the liquid crystal panel may not sufficiently respond by suddenly supplying a strong overshoot signal. For example, in a vertical alignment mode in low temperature, the liquid crystal has a remarkably low response characteristic particularly in the tone switching from black. In such a case, the levels of the overshoot signal C1 through Ck are set to weak undershoot levels in the first through kth fields so as to slightly cause the liquid crystal to respond, and the levels of the overshoot signal Ck+1 through Cn are set to original levels (to be aimed) of the overshoot signal in the subsequent k+1th through nth fields. With this invention, it is possible to accurately determine the overshoot parameter in the overshoot driving method as described above.

The evaluation apparatus of a liquid crystal display device of the present invention is preferably arranged so that, in rise response where A<B, the level of the video signal that the video signal generating circuit supplies to the liquid crystal panel sequentially changes from A to U1 through Un, then from U1 through Un to C1 through Cn, then from C1 through Cn to B while both U1 through Un and C1 through Cn are being swept, where U1 through Un are levels of an undershoot signal which satisfy $A < U1 \leqq \ldots \leqq Un \leqq B$, and the levels of the overshoot signal C1 through Cn satisfy $B \leqq C1 \geqq \ldots \geqq Cn$; and the waveform analysis device determines levels of the undershoot signal U1 through Un and levels of the overshoot signal C1 through Cj (j is an integer that satisfies $1 \leqq j \leqq n$) that realize a response waveform which substantially reaches a level of the attainment tone B fastest without exceeding the level of the attainment tone B, and sets Cj+1 through Cn to B if $j \leqq n-1$.

As described above, by supplying an undershoot signal to the liquid crystal panel before supplying the overshoot signal, it is possible to improve the response speed with respect to predetermined tone transition (in rise response from A to B). With this arrangement, it is possible to easily and accurately determine the optimum levels of the undershoot signal U1 through Un and the optimum levels of the overshoot signal C1 through Cj in the tone transition (from A to B).

Further, the evaluation apparatus of a liquid crystal display device of the present invention is arranged so that, in decay response where A>B, C1 through Cn with respect to the tones A and B satisfy $A > C1 \geqq \ldots \geqq Ck > B \geqq Ck+1 \leqq \ldots \leqq Cn$ (k is an integer that satisfies $1 \leqq k \leqq n$); a jth level of the overshoot signal Cj (j is an integer that satisfies $k+1 \leqq j \leqq n$) is set to a minimum value that does not cause a response waveform with respect to the level of the overshoot signal Cj to exceed a level of the attainment tone B; and if the response waveform with respect to the level of the overshoot signal Cj substantially reaches the level of the attainment tone B, Cj+1 through Cn are set to B.

With this arrangement, in a driving method for performing undershoot driving and then overshoot driving in decay response, it is possible to accurately determine the overshoot parameter.

Further, the evaluation apparatus of a liquid crystal display device of the present invention is preferably arranged so that, in decay response where A>B, the level of the video signal that the video signal generating circuit supplies to the liquid crystal panel sequentially changes from A to U1 through Un, then from U1 through Un to C1 through Cn, then from C1 through Cn to B while both U1 through Un and C1 through Cn are being swept, where U1 through Un are levels of an undershoot signal which satisfy A>U1≧ . . . ≧Un>B, and the levels of the overshoot signal C1 through Cn satisfy B≧C1≦ . . . ≦Cn; and the waveform analysis device determines levels of the undershoot signal U1 through Un and levels of the overshoot signal C1 through Cj (j is an integer that satisfies 1≦j≦n) that realize a response waveform which substantially reaches a level of the attainment tone B fastest without exceeding the level of the attainment tone B, and sets Cj+1 through Cn to B if j≦n−1.

As described above, by supplying an undershoot signal to the liquid crystal panel before supplying the overshoot signal, it is possible to improve the response speed with respect to predetermined tone transition (in decay response from A to B). With this arrangement, it is possible to easily and accurately determine the optimum levels of the undershoot signal U1 through Un and the optimum levels of the overshoot signal C1 through Cj in the tone transition (in decay response from A to B).

The evaluation apparatus of a liquid crystal display device of the present invention is so arranged that, in rise response where A<B, C1 through Cn with respect to the tones A and B satisfy B≦C1=C2= . . . =Cn; and a kth level of the overshoot signal Ck (k is an integer that satisfies 1≦k≦n) is set to a maximum value that does not cause a response waveform with respect to the levels of the overshoot signal C1 through Cn to exceed a level of the attainment tone B.

With this arrangement, in the n field (multi-field) overshoot driving, the same overshoot signal may be applied over all of the n fields. This virtually achieves the same effects as achieved in the driving method for applying C for n fields when sequentially supplying the levels A, C, and B in this order. The foregoing arrangement can determine the overshoot parameter in such a case of rise response.

Further, the evaluation apparatus of a liquid crystal display device of the present invention is arranged so that, in decay response where A>B, C1 through Cn with respect to the tones A and B satisfy B≧C1=C2= . . . =Cn; and a kth level of the overshoot signal Ck (k is an integer that satisfies 1≦k≦n) is set to a minimum value that does not cause a response waveform with respect to the levels of the overshoot signal C1 through Cn to exceed a level of the attainment tone B.

With this arrangement, in the n field (multi-field) overshoot driving, the same overshoot signal may be applied over all of the n fields. This virtually achieves the same effects as achieved in the driving method for applying C for n fields when sequentially supplying the levels A, C, and B in this order. The foregoing arrangement can determine the overshoot parameter in such a case of decay response.

Further, an evaluation method of a liquid crystal display device of the present invention is arranged so as to include the steps of repeatedly supplying to a liquid crystal panel to be evaluated, (i) a signal corresponding to an original tone, (ii) an overshoot signal, and (iii) a signal corresponding to an attainment tone sequentially in this order while sweeping a level of the overshoot signal, so as to analyze display results of the liquid crystal panel; and storing in association with the original tone and the attainment tone, a level of the overshoot signal that corresponds to an optimum one of the analysis results in accordance with analysis results.

With this method, the overshoot signal is actually supplied to (test OS driving is actually performed on) a liquid crystal panel to be evaluated so as to evaluate the display property of the liquid crystal panel. With this, it is possible to directly find out and store the optimum level of the overshoot signal in accordance with each liquid crystal panel.

In other words, it is possible to simplify the evaluation steps and easily obtain (store) the optimum level of the overshoot signal with high accuracy without significantly affected by the panel characteristic and detection error, compared with a conventional evaluation method which determines a tentative level of the overshoot signal based on the waveform in normal driving, etc., and then checks and modifies the tentative overshoot signal through performing the OS driving based on the tentative overshoot signal.

An evaluation method of a liquid crystal display device of the present invention may be arranged so as to include the steps of repeatedly supplying to a liquid crystal panel to be evaluated, a signal corresponding to an original tone and then, in accordance with tone transition from the original tone to an attainment tone, either (i) an overshoot test signal or (ii) both an overshoot test signal and an undershoot test signal while sweeping a level of the test signal, so as to analyze display results of the liquid crystal panel; and storing in association with the original tone and the attainment tone, a level of the test signal that corresponds to an optimum one of analysis results.

Further, an evaluation method of a liquid crystal display device of the present invention which supplies an overshoot signal to a liquid crystal panel to be evaluated so as to evaluate an optimum level of an overshoot signal in accordance with a response result is arranged so as to include the steps of (i) supplying to the liquid crystal panel a video signal whose level changes from A to C, then from C to B, where A is a level corresponding to a tone before being changed, B is a level corresponding to a tone to be attained, and C is a level of the overshoot signal (including a case where C=B); (ii) sensing a display image of the liquid crystal panel that is displayed in accordance with the video signal; (iii) analyzing a waveform of the sensed display image; and (iv) storing in association with the tone before being changed and the tone to be attained, a level of the overshoot signal C that realizes a response waveform which reaches the tone to be attained fastest without overresponse, among response waveforms with respect to the level of the overshoot signal C, the steps (i) through (iii) being repeated while sweeping the level of the overshoot signal C.

With this arrangement, the optimum overshoot parameter is determined in order to perform the overshoot driving for improving the response characteristic of liquid crystal. For achieving this, a video signal whose level changes from A to C, then from C to B while the level of the overshoot signal C being swept is outputted so as to cause the liquid crystal panel to display a display image. Here, A is a tone before being changed, B is a tone to be attained, and C is a level of an overshoot signal Next, a display image on the liquid crystal panel in accordance with the outputted level is sensed, and a waveform of the sensed display image is analyzed. Then, as the optimum overshoot parameter, a level of the overshoot signal C that realizes a response waveform which reaches the attainment tone B fastest without overresponse is stored in association with the tone before being changed A and the attainment tone B.

Therefore a Look-up Table of the optimum overshoot parameter C in association with the tone before being changed A and the attainment tone B may be set in the drive circuit for overshoot driving of the liquid crystal panel. With this, the drive circuit can refer to the LUT in response to the tone before being changed A and attainment tone B of an inputted video signal so as to determine the optimum overshoot parameter, thereby properly performing overshoot driving on the liquid crystal panel.

In this manner, the present invention can obtain the optimum overshoot parameter with ease and high accuracy. Further, a liquid crystal panel without the function of overshoot driving can be also measured using the overshoot signal. If the overshoot driving is newly introduced to the liquid crystal panel later, two operations, namely circuit designing and the determination of the overshoot parameter, are generally required. In contrast, the present invention can obtain the parameter for the overshoot driving even if the circuit has not been complete yet, namely even if the overshoot driving cannot be performed.

Further, the evaluation method of a liquid crystal display device of the present invention is so arranged that the level of the video signal that a video signal generating circuit supplies to the liquid crystal panel sequentially changes from A to C1 through Cn, then from C1 through Cn to B over n field periods (n is an integer not less than 1) while levels of the overshoot signal C1 through Cn are being swept, where the levels of the overshoot signal over the n field periods are sequentially C1, C2, . . . , and Cn in this order, overshoot driving being performed over the n field periods.

The level of the overshoot signal while being applied needs not to be constant. The overshoot driving may be performed over multiple field periods if the response speed of liquid crystal is remarkably low under low temperature, in double speed driving, and the like. The overshoot driving can have a broader range of applications by applying different levels of the overshoot signal with respect to each of the field periods. The video signal generating circuit thus outputs the levels of the overshoot signal C1, C2, . . . , and Cn (n is an integer not less than 1) sequentially in this order respectively for predetermined periods. Namely, the video signal generating circuit outputs a signal having (n+2) types of levels, including the tone before being changed A and the attainment tone B.

With this, it is possible to accurately and simply determine the overshoot parameter corresponding to the overshoot driving over the multiple fields.

A liquid crystal display device of the present invention is arranged so that a drive circuit stores as a Look-up Table for overshoot driving, a level of an overshoot signal C which is determined by the foregoing evaluation apparatus.

With this arrangement, the drive circuit stores the Look-up Table composed of the optimum overshoot parameter with respect to the liquid crystal panel to be used. This realizes a liquid crystal display device which can respond at high speed without deteriorating video images.

The liquid crystal display device of the present invention is arranged so that the drive circuit further stores as a Look-up Table for overshoot driving, levels of the overshoot signal C1 through Cn which are determined by the foregoing evaluation apparatus.

With this arrangement, for performing the overshoot driving over multiple fields, the drive circuit stores the Look-up Table composed of the optimum overshoot parameter with respect to the liquid crystal panel to be used. This realizes a liquid crystal display device which can respond at high speed without deteriorating video images.

As described above, a liquid crystal device of the present invention which includes a liquid crystal panel and an overshoot drive circuit may be so arranged that the overshoot drive circuit stores an optimum level of an overshoot signal as a Look-up Table; and the optimum level of the overshoot signal is obtained by an evaluation method that has the steps of repeatedly supplying to the liquid crystal panel, (i) a signal corresponding to an original tone, (ii) an overshoot signal, and (iii) a signal corresponding to an attainment tone sequentially in this order while sweeping a level of the overshoot signal, so as to analyze display results of the liquid crystal panel; and in accordance with analysis results, determining the optimum level of the overshoot signal in association with the original tone and the attainment tone.

Further, a liquid crystal display device of the present invention which includes a liquid crystal panel and a drive circuit may be so arranged that the drive circuit stores as a Look-up Table an optimum level of either (i) an overshoot test signal or (ii) both an overshoot test signal and an undershoot test signal in accordance with tone transition from an original tone to an attainment tone; and the optimum level is set to a level of the test signal that corresponds to an optimum one of display results, which is obtained by repeatedly supplying to the liquid crystal panel, a signal corresponding to the original tone and then, in accordance with the tone transition, either (i) the overshoot test signal or (ii) both the overshoot test signal and the undershoot test signal while sweeping either a level of the signal (i) or levels of both the signals (ii), so as to analyze the display results of the liquid crystal panel.

Further, the liquid crystal display device of the present invention is preferably arranged so that the drive circuit stores as a Look-up Table an optimum combination of a plurality of levels of the overshoot signal in predetermined tone transition; and the optimum combination is set to a combination of levels of the overshoot test signal that corresponds to an optimum one of display results, which is obtained by repeatedly supplying to the liquid crystal panel, a signal corresponding to the original tone and then the overshoot test signal having a plurality of levels while sweeping the levels of the overshoot test signal, so as to analyze the display results of the liquid crystal panel.

Further, the liquid crystal display device of the present invention is preferably arranged so that the drive circuit stores as a Look-up Table an optimum combination of a level of the overshoot signal and a level of an undershoot signal in predetermined tone transition; and the optimum combination is set to a combination of a level of the undershoot test signal and a level of the overshoot test signal that corresponds to an optimum one of display results, which is obtained by repeatedly supplying to the liquid crystal panel, a signal corresponding to the original tone, the undershoot test signal, and the overshoot test signal sequentially in this order while sweeping the levels of the undershoot and overshoot test signals, so as to analyze the display results of the liquid crystal panel.

Further, the liquid crystal display device of the present invention is preferably arranged so that the optimum one of display results is a display result where the attainment tone is substantially displayed fastest without exceeding the attainment tone.

Further, the liquid crystal display device of the present invention is preferably arranged so that the Look-up Table is stored with respect to each of a plurality of temperatures.

Further, a liquid crystal display device of the present invention which includes a liquid crystal panel, a drive circuit in which a level of an overshoot signal C is stored as a Look-up Table for overshoot driving, and an evaluation apparatus for determining the level of the overshoot signal C is so arranged that the evaluation apparatus includes a video signal generating circuit for supplying a video signal to the liquid crystal panel to be evaluated; an optical light-receiving element facing a display section of the liquid crystal panel; and a waveform analysis device to which an output waveform is supplied from the optical light-receiving element, the video signal generating circuit supplying to the liquid crystal panel a video signal whose level changes from A to C, then from C to B, where A is a tone before being changed, B is a tone to be attained, and C is a level of an overshoot signal (including a case where C=B), while sweeping the level of the overshoot signal C; and the waveform analysis device stores in association with the tone before being changed A and the attainment tone B, a level of the overshoot signal C that realizes a response waveform which reaches the attainment tone B fastest without overresponse, among response waveforms obtained while sweeping the level of the overshoot signal C.

Further, the liquid crystal display device is preferably arranged so that the drive circuit further stores levels of the overshoot signal C1 through Cn as a Look-up Table for overshoot driving; the level of the video signal that the video signal generating circuit supplies to the liquid crystal panel sequentially changes from A to C1 through Cn, then from C1 through Cn to B over n field periods (n is an integer not less than 1) while the levels of the overshoot signal C1 through Cn are being swept, where the levels of the overshoot signal over the n field periods are sequentially C1, C2, . . . , and Cn in this order; and the waveform analysis device stores in association with the tone before being changed A and the attainment tone B, levels of the overshoot signals C1 through Cn that realize a response waveform which reaches the attainment tone B fastest without overresponse, among response waveforms obtained while sweeping the levels of the overshoot signal C1 through Cn.

Further, the liquid crystal display device is preferably arranged so that the drive circuit further stores levels of the overshoot signal C1 through Cn and levels of an undershoot signal U1 through Un as a Look-up Table for overshoot driving; in rise response where A<B, the level of the video signal that the video signal generating circuit supplies to the liquid crystal panel sequentially changes from A to U1 through Un, then from U1 through Un to C1 through Cn, then from C1 through Cn to B while both U1 through Un and C1 through Cn are being swept, where U1 through Un are levels of the undershoot signal which satisfy $A<U1\leqq \ldots \leqq Un\leqq B$, and the levels of the overshoot signal C1 through Cn satisfy $B\leqq C1\geqq \ldots \geqq Cn$; and the waveform analysis device determines levels of the undershoot signal U1 through Un and levels of the overshoot signal C1 through Cj (j is an integer that satisfies $1\leqq j\leqq n$) that realize a response waveform which substantially reaches a level of the attainment tone B fastest without exceeding the level of the attainment tone B, and sets Cj+1 through Cn to B if $j\leqq n-1$.

Further, the liquid crystal display device is preferably arranged so that the drive circuit further stores levels of the overshoot signal C1 through Cn and levels of an undershoot signal U1 through Un as a Look-up Table for overshoot driving; in decay response where A>B, the level of the video signal that the video signal generating circuit supplies to the liquid crystal panel sequentially changes from A to U1 through Un, then from U1 through Un to C1 through Cn, then from C1 through Cn to B while both U1 through Un and C1 through Cn are being swept, where U1 through Un are levels of the undershoot signal which satisfy $A>U1\geqq \ldots \geqq Un>B$, and the levels of the overshoot signal C1 through Cn satisfy $B\geqq C1\leqq \ldots \leqq Cn$; and the waveform analysis device determines levels of the undershoot signal U1 through Un and levels of the overshoot signal C1 through Cj (j is an integer that satisfies $1\leqq j\leqq n$) that realize a response waveform which substantially reaches a level of the attainment tone B fastest without exceeding the level of the attainment tone B, and sets Cj+1 through Cn to B if $j\leqq n-1$.

Further, a liquid crystal display device which includes a liquid crystal panel, and a drive circuit in which a level of an overshoot signal C is stored as a Look-up Table for overshoot driving is preferably arranged so that the level of the overshoot signal C is evaluated by a method which supplies an overshoot signal to a liquid crystal panel to be evaluated so as to evaluate an optimum level of an overshoot signal in accordance with a response result, the method comprising the steps of (i) supplying to the liquid crystal panel a video signal whose level changes from A to C, then from C to B, where A is a tone before being changed, B is a tone to be attained, and C is a level of the overshoot signal (including a case where C=B); (ii) sensing a display image of the liquid crystal panel that is displayed in accordance with the video signal; (iii) analyzing a waveform of the sensed display image; and (iv) storing in association with the tone before being changed A and the attainment tone B, a level of the overshoot signal C that realizes a response waveform which reaches the attainment tone B fastest without overresponse, among response waveforms with respect to the level of the overshoot signal C, the steps (i) through (iii) being repeated while sweeping the level of the overshoot signal C.

Further, the liquid crystal display device is preferably arranged so that the drive circuit further stores levels of the overshoot signal C1 through Cn and levels of an undershoot signal U1 through Un as a Look-up Table for overshoot driving; the level of the video signal that a video signal generating circuit supplies to the liquid crystal panel sequentially changes from A to C1 through Cn, then from C1 through Cn to B over n field periods (n is an integer not less than 1) while levels of the overshoot signal C1 through Cn are being swept, where the levels of the overshoot signal over the n field periods are sequentially C1, C2, . . . , and Cn in this order, overshoot driving being performed over the n field periods.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A liquid crystal display device which includes a liquid crystal panel and a drive circuit, wherein:

the drive circuit stores as a Look-up Table an optimum level of a test signal consisting of either only an overshoot signal or both an overshoot signal and an undershoot signal in accordance with tone transition from an original tone to an attainment tone; and the optimum level is set to a level of the test signal that corresponds to an optimum one of display results, which is obtained by an evaluation method that has the steps of repeatedly supplying to the liquid crystal panel, (i) a signal corresponding to an original tone and then, in accordance with tone transition, (ii) the test signal, that is either only the overshoot signal or both the overshoot signal and the undershoot signal, and (iii) a signal corresponding to an attainment tone sequentially in this order while sweeping a level of the test signal, so as to analyze display results of the liquid crystal panel; and in accordance with analysis results, determining the optimum level of the test signal in association with the original tone and the attainment tone, wherein the optimum one of the display results is a display result of the display results where the attainment tone is substantially displayed faster than a remainder of the display results without exceeding the attainment tone.

2. The liquid crystal display device as set forth in claim 1, wherein:

the drive circuit stores an optimum level of an overshoot signal as a Look-up Table; and the optimum level of the overshoot signal is obtained by an evaluation method that has the steps of repeatedly supplying to the liquid crystal panel, (i) a signal corresponding to an original tone, (ii) an overshoot signal, and (iii) a signal corresponding to an attainment tone sequentially in this order while sweeping a level of the overshoot signal, so as to analyze display results of the liquid crystal panel; and in accordance with analysis results, determining the optimum level of the overshoot signal in association with the original tone and the attainment tone.

3. The liquid crystal display device as set forth in claim 1, wherein:

the drive circuit stores as a Look-up Table an optimum combination of a plurality of levels of the overshoot signal in predetermined tone transition; and the optimum combination is set to a combination of levels of the overshoot test signal that corresponds to an optimum one of display results, which is obtained by repeatedly supplying to the liquid crystal panel, a signal corresponding to the original tone and then the overshoot test signal having a plurality of levels while sweeping the levels of the overshoot test signal, so as to analyze the display results of the liquid crystal panel.

4. The liquid crystal display device as set forth in claim 1, wherein:

the drive circuit stores as a Look-up Table an optimum combination of a level of the overshoot signal and a level of an undershoot signal in predetermined tone transition; and the optimum combination is set to a combination of a level of the undershoot test signal and a level of the overshoot test signal that corresponds to an optimum one of display results, which is obtained by repeatedly supplying to the liquid crystal panel, a signal corresponding to the original tone, the undershoot test signal, and the overshoot test signal sequentially in this order while sweeping the levels of the undershoot and overshoot test signals, so as to analyze the display results of the liquid crystal panel.

5. The liquid crystal display device as set forth in claim 1, wherein:

the Look-up Table is stored with respect to each of a plurality of temperatures.

6. The liquid crystal display device as set forth in claim 2, wherein:

the drive circuit supplies to the liquid crystal panel a video signal whose level changes from A to C, then from C to B, where A is a level corresponding to a tone before being changed, B is a level corresponding to a tone to be attained, and C is a level of an overshoot signal (including a case where C=B), while sweeping the level of the overshoot signal C; and in the Look-up Table, stored is, in association with the tone before being changed and the tone to be attained, a level of the overshoot signal C that realizes a response waveform which reaches the tone to be attained fastest without overresponse, among response waveforms obtained while sweeping the level of the overshoot signal C.

7. The liquid crystal display device as set forth in claim 1, wherein:

the drive circuit stores an optimum level of an overshoot signal as a Look-up Table; and in the Look-Up Table, analyzed are waveforms of the output of a display image of the liquid crystal panel so as to obtain (i) relationship between a maximum or minimum level in each of the waveforms and a level corresponding to a desired attainment tone, and (ii) a time required for substantially attaining the level corresponding to the desired attainment tone, and stored is, in association with the original tone and the attainment tone, as the optimal level of the test signal, a level of the overshoot signal that corresponds to an optimum one of the waveforms in accordance with analysis results.

8. A liquid crystal display device which includes a liquid crystal panel and a drive circuit, wherein:

the drive circuit stores as a Look-up Table an optimum level of a test signal consisting of either only an overshoot signal or both an overshoot signal and an undershoot signal in accordance with tone transition form an original tone to an attainment tone; and the optimum level of the test signal is obtained by an evaluation method that has the steps of repeatedly supplying to the liquid crystal panel, (i) a signal corresponding to an original tone, (ii) the test signal, and (iii) a signal corresponding to an attainment tone sequentially in this order while sweeping a level of the test signal, wherein the level of the test signal at each trial of the sweeping is selected and tested in turn from a plurality of predetermined levels and without calculation of an ideal optimum level of the test signal, so as to analyze display results of the liquid crystal panel; and in accordance with analysis results, determining the optimum level of the test signal in association with the original tone and the attainment tone, wherein the optimum level is set to a level of the test signal that corresponds to an optimum one of the display results and wherein the optimum one of the display results is a display result of the display results where the attainment tone is substantially displayed faster than a remainder of the display results without exceeding the attainment tone.

9. The crystal display device as set forth in claim 8, wherein the level of the test signal at each trial of sweeping is selected and tested in turn from a plurality of predetermined levels without calculation of a predicted value of an ideal optimum level of the test signal based on the original tone or the attainment tone, and regardless of the predicted value.

10. The liquid crystal display device as set forth in claim 9, wherein the level of the test signal at each trial of the sweeping is selected and tested in turn from the plurality of predetermined levels which satisfy a rule that the level is equal to or more than a level which corresponds to the attainment tone in case of overshoot and is equal to or less than a level which corresponds to the attainment tone in case of undershoot.

11. The liquid crystal display device as set forth in claim 8, wherein:

the drive circuit stores as a Look-up Table an optimum combination of a plurality of levels of the overshoot signal in predetermined tone transition; and the optimum combination is set to a combination of levels of the overshoot test signal that corresponds to an optimum one of display results, which is obtained by repeatedly supplying to the liquid crystal panel, a signal corresponding to the original tone and then the overshoot test signal having a plurality of levels while sweeping the levels of the overshoot test signal, so as to analyze the display results of the liquid crystal panel.

12. The liquid crystal display device as set forth in claim 8, wherein:

the drive circuit stores as a Look-up Table an optimum combination of a level of the overshoot signal and a level of an undershoot signal in predetermined tone transition; and the optimum combination is set to a combination of a level of the undershoot test signal and a level of the overshoot test signal that corresponds to an optimum one of display results, which is obtained by repeatedly supplying to the liquid crystal panel, a signal corresponding to the original tone, the undershoot test signal, and the overshoot test signal sequentially in this order while sweeping the levels of the undershoot and overshoot test signals, so as to analyze the display results of the liquid crystal panel.

13. The liquid crystal display device as set forth in claim 8, wherein:

the Look-up Table is stored with respect to each of a plurality of temperatures.

* * * * *